US010272591B2

(12) United States Patent
Foley et al.

(10) Patent No.: US 10,272,591 B2
(45) Date of Patent: Apr. 30, 2019

(54) KINETIC LOG SPLITTER

(71) Applicant: Blount, Inc., Portland, OR (US)

(72) Inventors: Patrick Foley, Evergreen, CO (US); Emanuel Guzman, Lakewood, CO (US); Ron Bowman, Golden, CO (US); Marilena Papaianache, Littleton, CO (US)

(73) Assignee: Blount, Inc., Portland, OR (US)

( * ) Notice: Subject to any disclaimer, the term of this patent is extended or adjusted under 35 U.S.C. 154(b) by 316 days.

(21) Appl. No.: 15/204,586

(22) Filed: Jul. 7, 2016

(65) Prior Publication Data

US 2017/0008191 A1 Jan. 12, 2017

Related U.S. Application Data

(60) Provisional application No. 62/191,275, filed on Jul. 10, 2015.

(51) Int. Cl.
*B27L 7/06* (2006.01)

(52) U.S. Cl.
CPC ..... *B27L 7/06* (2013.01)

(58) Field of Classification Search
CPC ..... B27L 7/00; B27L 7/06; B27L 7/08
See application file for complete search history.

(56) References Cited

U.S. PATENT DOCUMENTS 4,116,251 A 9/1978 Graney
5,337,810 A * 8/1994 McCormack ..... B27L 7/00 144/193.1
2013/0000785 A1 1/2013 Banjo
2015/0328798 A1* 11/2015 Miller ..... B27G 21/00 144/195.8

FOREIGN PATENT DOCUMENTS

DE 102014003530 A1 4/2015

* cited by examiner

*Primary Examiner* — Matthew Katcoff
(74) *Attorney, Agent, or Firm* — Schwabe Williamson & Wyatt, P.C.

(57) ABSTRACT

A kinetic log splitter having: a frame; a geared rack; a pinion coupled with the geared rack and to cause the geared rack to translate linearly based on rotation of the pinion; an actuation handle that engages the geared rack and the pinion; and a linkage system coupling the actuation handle to the geared rack that allows disengagement of at least a portion of the linkage system in response to a stall condition that occurs due to a stall of the geared rack during the operation of the geared rack of the kinetic log splitter. The kinetic log splitter may be towable and/or include a push plate splinter recovery system.

20 Claims, 24 Drawing Sheets

KINETIC LOG SPLITTER

CROSS-REFERENCE TO RELATED APPLICATION

This application claims the priority benefit of the earlier filing date of U.S. Provisional Application No. 62/191,275, filed Jul. 10, 2015, which is hereby incorporated herein by reference in its entirety.

TECHNICAL FIELD

Embodiments herein relate to the field of log splitters, and, more specifically, to a kinetic log splitter.

BACKGROUND

Utilizing kinetic energy stored in flywheels to split wood allows for efficient use of fuel and a productive use of an operator's time. Wood splitting devices typically function by driving a wedge into a log either by pushing the log onto the wedge, or by forcing a wedge into a log. Many conventional kinetic log splitters force a stationary rack onto a moving pinion which is hard on both the machine and the operator pushing down on the rack. Providing an effective means of decoupling the drive mechanism from the energy storing flywheels will reduce the shock load that is experienced by the operator, and reduce the amount of wear on the log splitter.

BRIEF DESCRIPTION OF THE DRAWINGS

Embodiments will be readily understood by the following detailed description in conjunction with the accompanying drawings and the appended claims. Embodiments are illustrated by way of example and not by way of limitation in the figures of the accompanying drawings.

DETAILED DESCRIPTION OF DISCLOSED EMBODIMENTS

Figure 1:
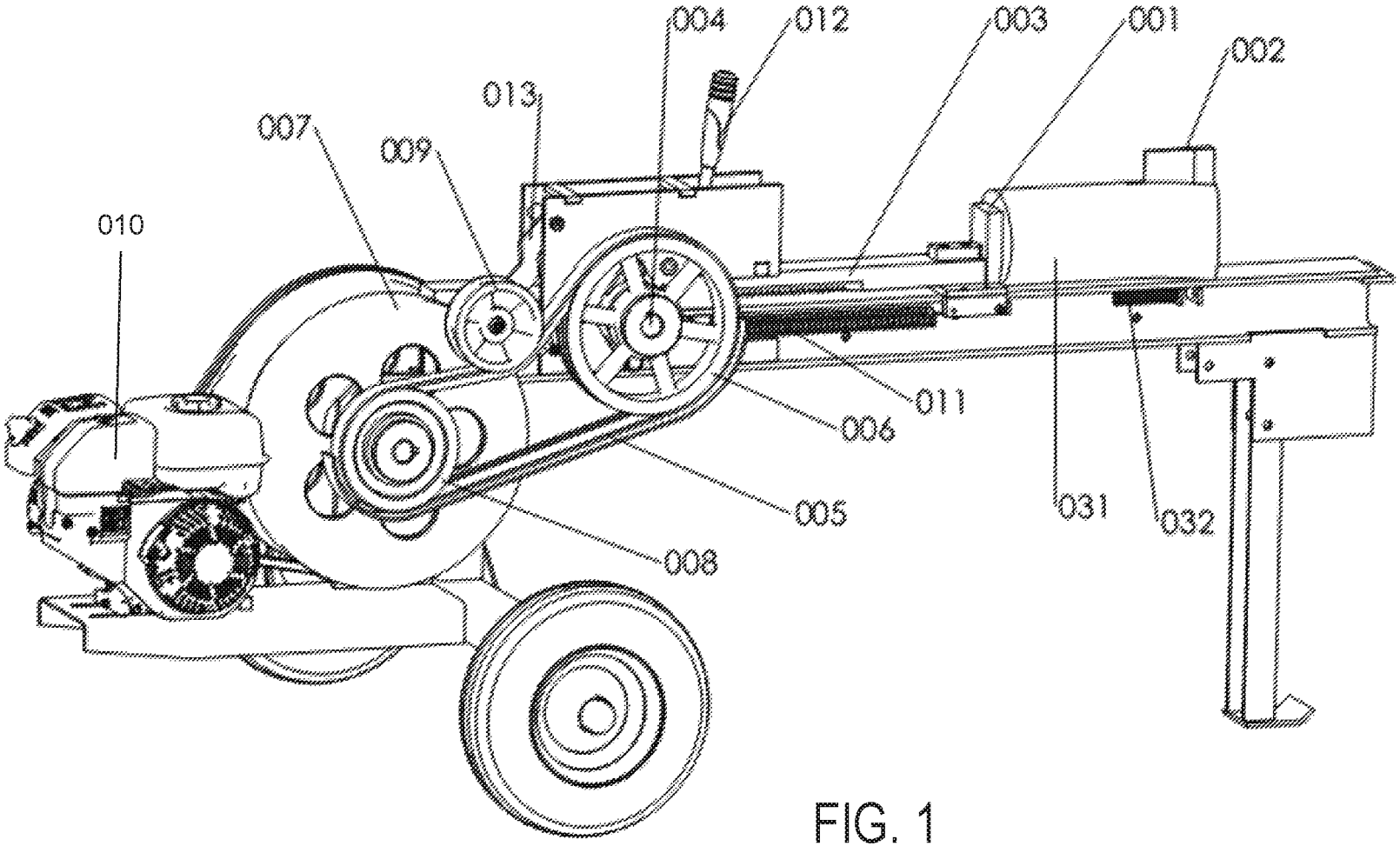
FIG. 1 illustrates a first side view of a kinetic splitter and components thereof, in accordance with various embodiments.
Figure 2:
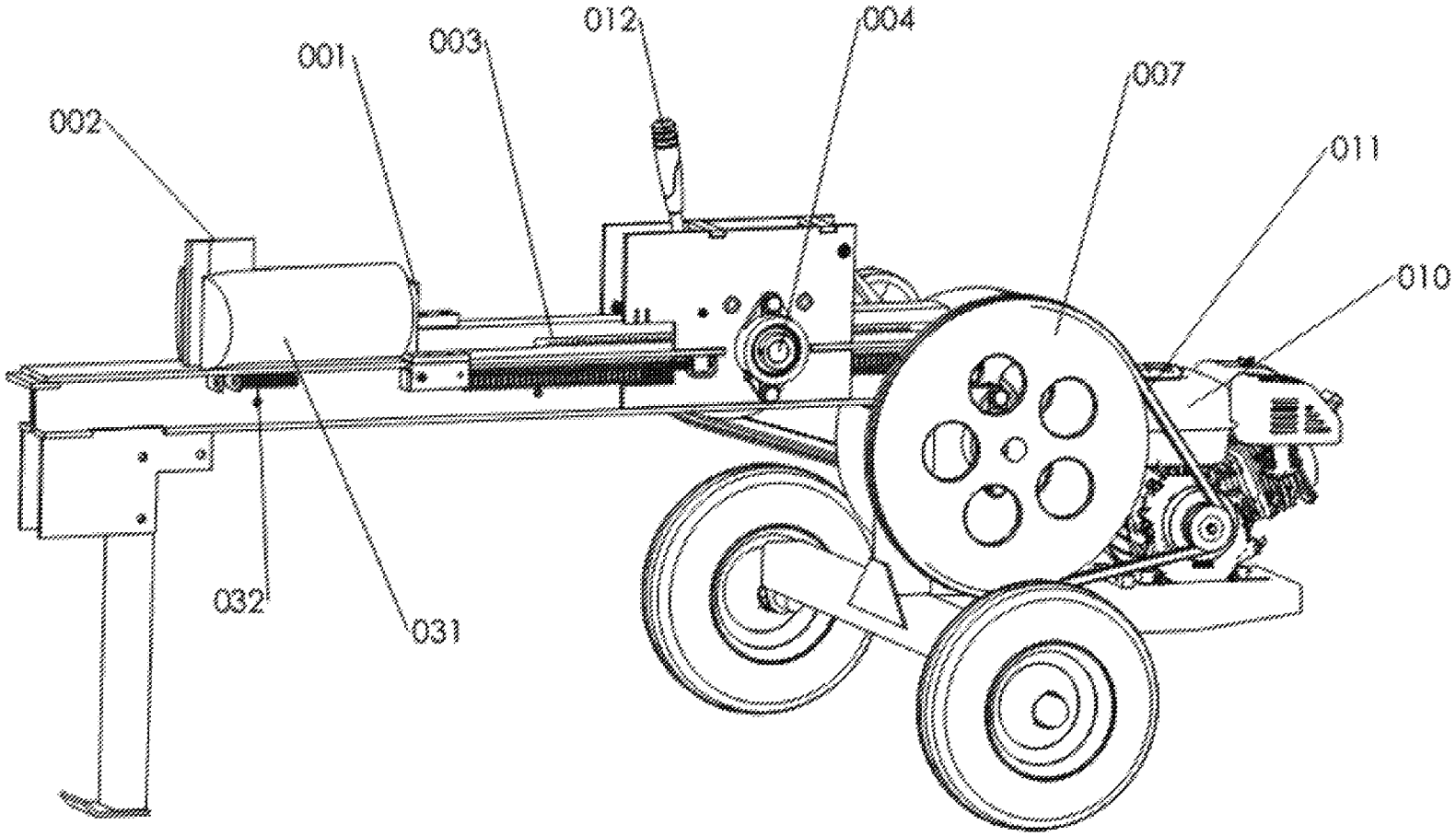
FIG. 2 illustrates an alternative side view of a kinetic splitter and components thereof, in accordance with various embodiments.
Figure 3A:
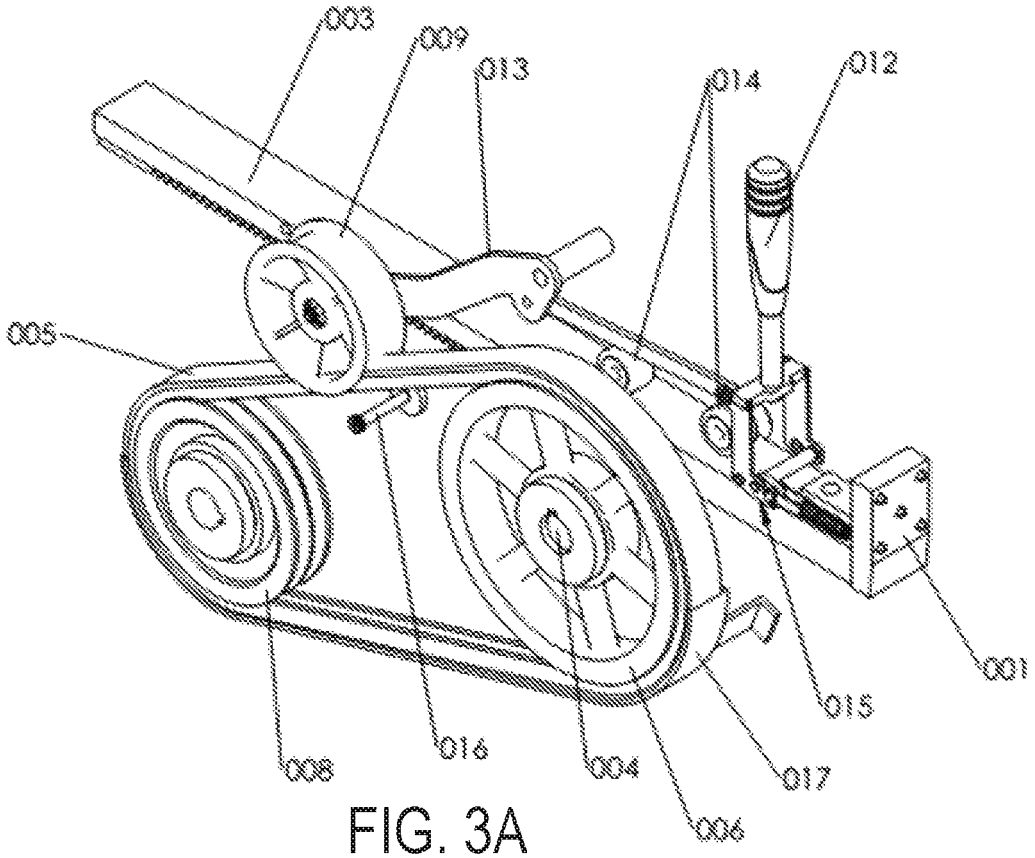
FIG. 3A illustrates a first side view of a belt drive system of a kinetic splitter and components thereof in a disengaged state, in accordance with various embodiments.
Figure 3B:
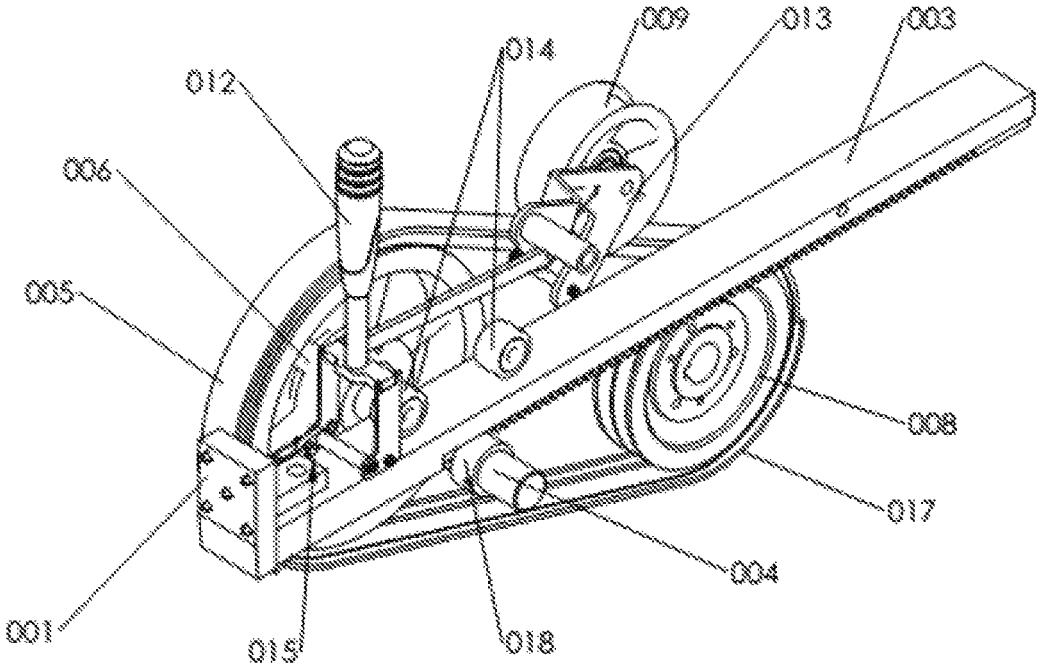
FIG. 3B illustrates a second side view of a belt drive system of a kinetic splitter and components thereof in a disengaged state, in accordance with various embodiments.
Figure 4A:
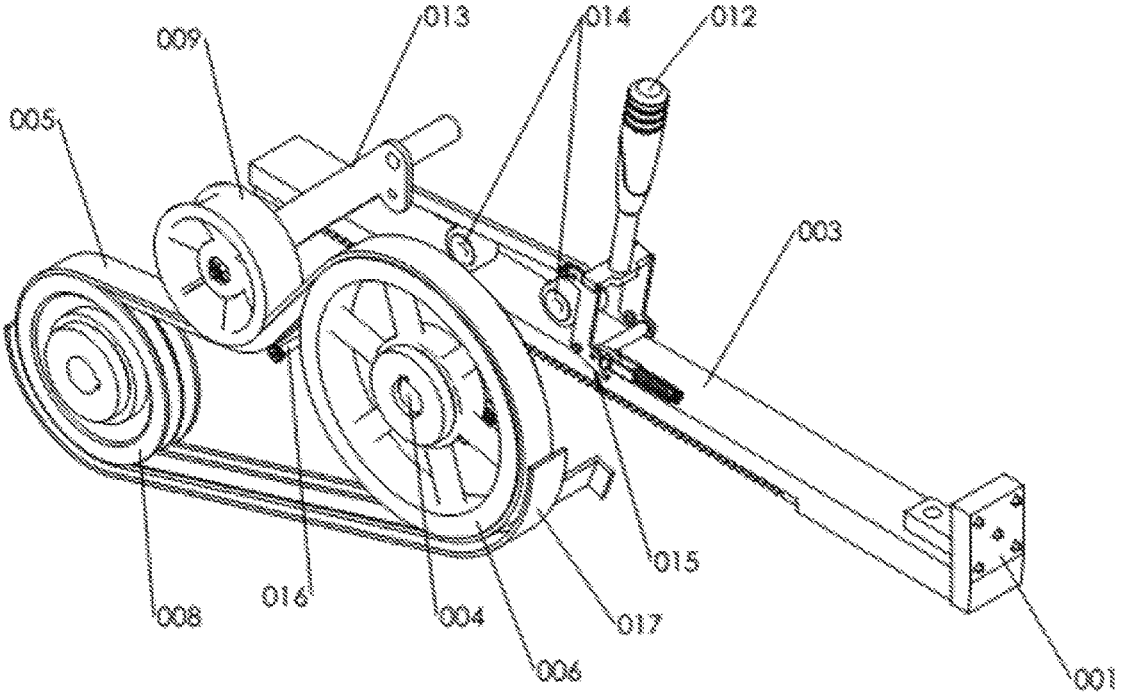
FIG. 4A illustrates a first side view of a belt drive system of a kinetic splitter and components thereof in an engaged state, in accordance with various embodiments.
Figure 4B:
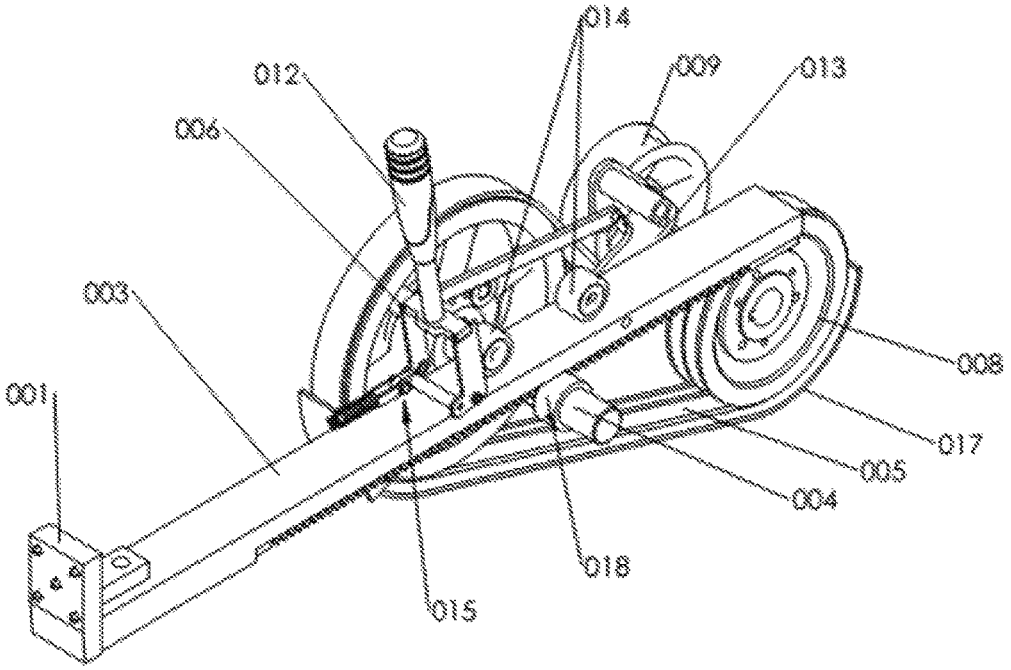
FIG. 4B illustrates a second side view of a belt drive system of a kinetic splitter and components thereof in an engaged state, in accordance with various embodiments.
Figure 5A:
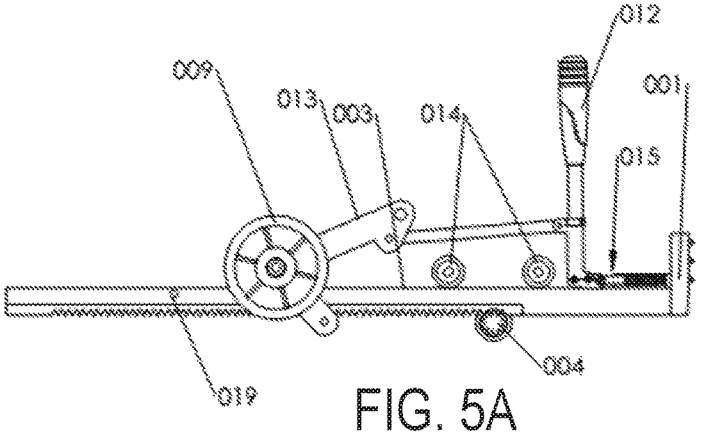
FIG. 5A illustrates a first simplified side view of a kinetic splitter and components thereof, in accordance with various embodiments.
Figure 5B:
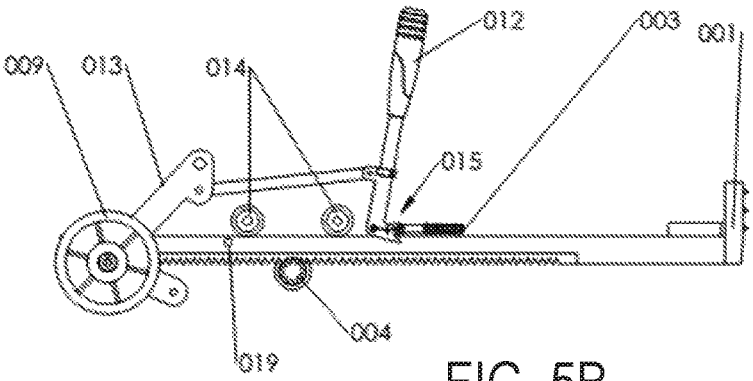
FIG. 5B illustrates a second simplified side view of a kinetic splitter and components thereof, in accordance with various embodiments.
Figure 5C:
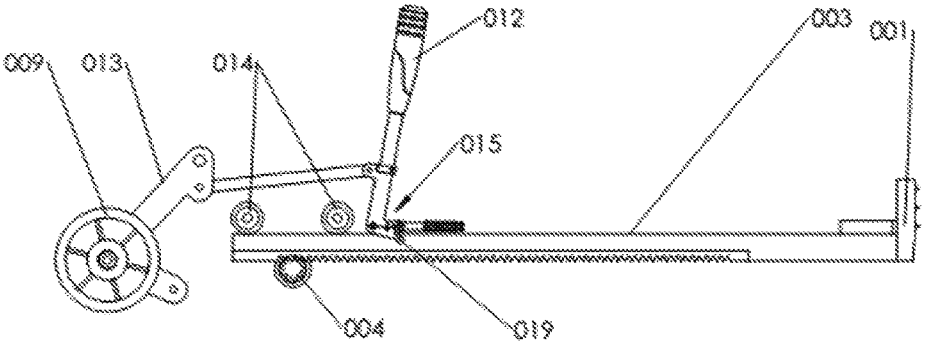
FIG. 5C illustrates a third simplified side view of a kinetic splitter and components thereof, in accordance with various embodiments.
Figure 6A:
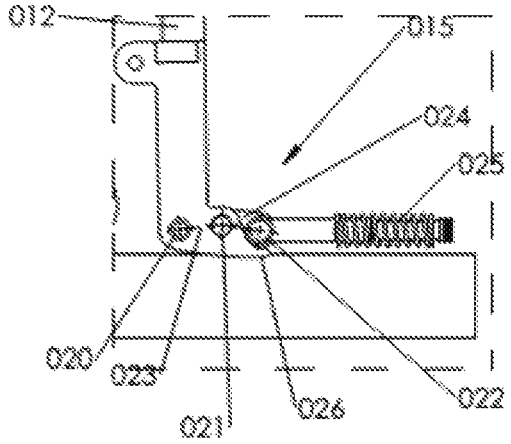
FIG. 6A illustrates a first simplified view of a linkage of a kinetic splitter and components thereof, in accordance with various embodiments.
Figure 6B:
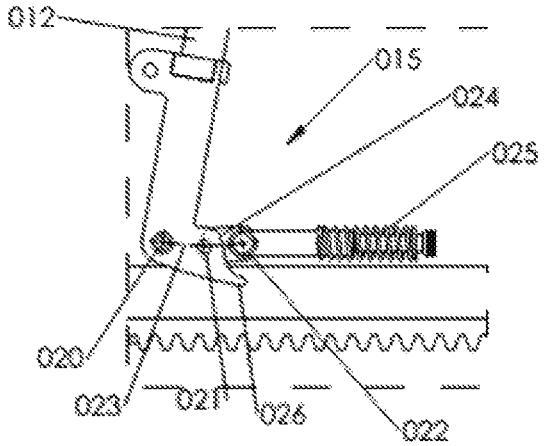
FIG. 6B illustrates a second simplified view of a linkage of a kinetic splitter and components thereof, in accordance with various embodiments.
Figure 6C:
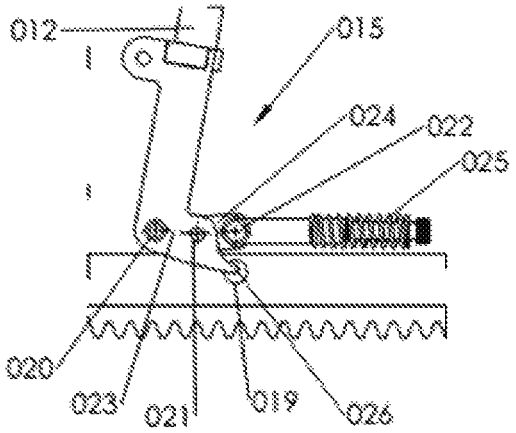
FIG. 6C illustrates a third simplified view of a linkage of a kinetic splitter and components thereof, in accordance with various embodiments.
Figure 7A:
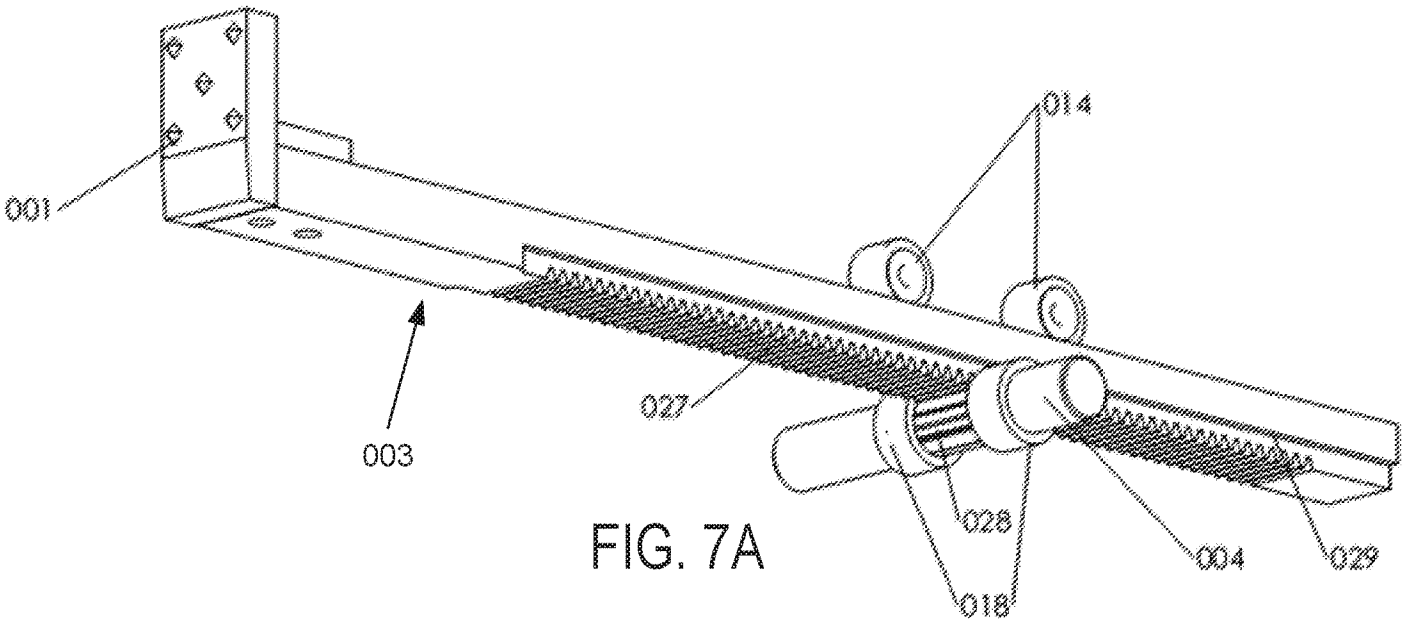
FIG. 7A illustrates a first simplified view of a rack and pinion of a kinetic splitter and components thereof, in accordance with various embodiments.
Figure 7B:
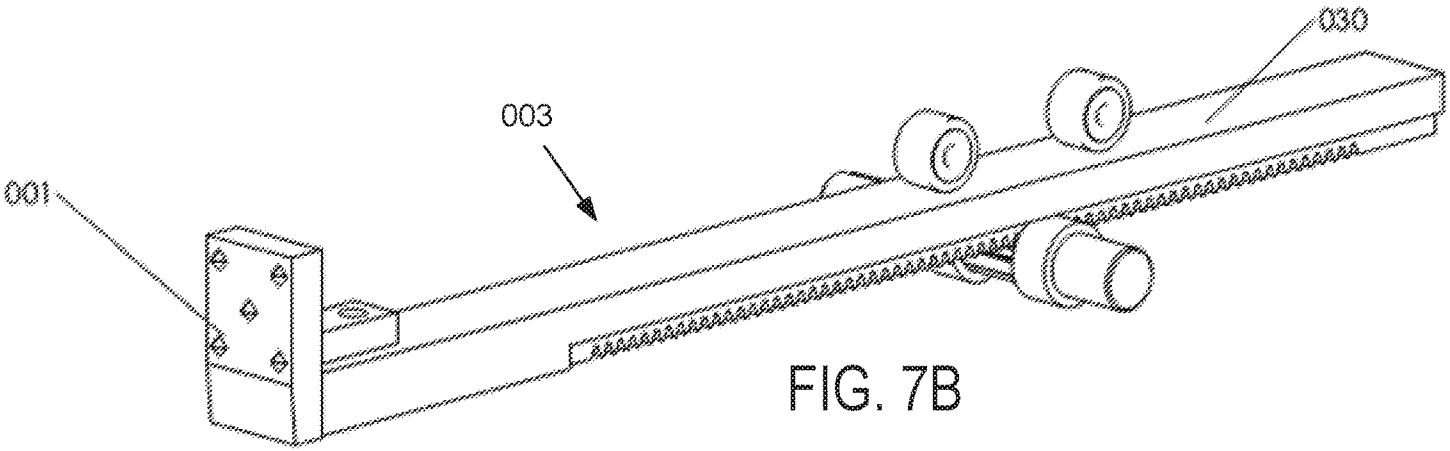
FIG. 7B illustrates a second simplified view of a rack and pinion of a kinetic splitter and components thereof, in accordance with various embodiments.

In the following detailed description, reference is made to the accompanying drawings which form a part hereof, and in which are shown by way of illustration embodiments that may be practiced. It is to be understood that other embodiments may be utilized and structural or logical changes may be made without departing from the scope. Therefore, the following detailed description is not to be taken in a limiting sense, and the scope of embodiments is defined by the appended claims and their equivalents.

Various operations may be described as multiple discrete operations in turn, in a manner that may be helpful in understanding embodiments; however, the order of description should not be construed to imply that these operations are order dependent.

The description may use perspective-based descriptions such as up/down, back/front, and top/bottom. Such descriptions are merely used to facilitate the discussion and are not intended to restrict the application of disclosed embodiments.

The terms "coupled" and "connected," along with their derivatives, may be used. It should be understood that these terms are not intended as synonyms for each other. Rather, in particular embodiments, "connected" may be used to indicate that two or more elements are in direct physical or electrical contact with each other. "Coupled" may mean that two or more elements are in direct physical or electrical contact. However, "coupled" may also mean that two or more elements are not in direct contact with each other, but yet still cooperate or interact with each other.

For the purposes of the description, a phrase in the form "A/B" or in the form "A and/or B" means (A), (B), or (A and B). For the purposes of the description, a phrase in the form "at least one of A, B, and C" means (A), (B), (C), (A and B), (A and C), (B and C), or (A, B and C). For the purposes of the description, a phrase in the form "(A)B" means (B) or (AB); that is, A is an optional element.

The description may use the terms "embodiment" or "embodiments," which may each refer to one or more of the same or different embodiments. Furthermore, the terms "comprising," "including," "having," and the like, as used with respect to embodiments, are synonymous, and are generally intended as "open" terms (e.g., the term "including" should be interpreted as "including but not limited to," the term "having" should be interpreted as "having at least," the term "includes" should be interpreted as "includes but is not limited to," etc.).

With respect to the use of any plural and/or singular terms herein, those having skill in the art can translate from the plural to the singular and/or from the singular to the plural as is appropriate to the context and/or application. The various singular/plural permutations may be expressly set forth herein for sake of clarity.

Embodiments herein provide a log splitting device wherein a ram (also referred to as a push plate) mechanism forces wood onto a wedge portion. In various embodiments a wedge may be forcibly moved into wood that is held in place by an anvil. In various embodiments the moving mechanism may be driven by a rack and pinion system.

Specifically, in some embodiments a kinetic splitter may have a belt drive system that may include a clutch system to link energy of a flywheel to a rack and pinion. The belt drive system may be designed to prevent damage to the rack and pinion by controlling the deceleration of the flywheel. The rate of deceleration may be proportional to the energy absorbed by the rack, pinion, pinion bearings, and/or the wood being split. If the flywheels were to stop immediately, one or more of the rack, pinion, and/or pinion bearings could be damaged. Using the disclosed belt drive system, the flywheel may be instead decelerated over a time span of between 0.3 seconds to 0.5 seconds (or a different time span in different embodiments), which may result in approximately 18,000 pounds of force being delivered to the kinetic splitter.

In embodiments, the disclosed kinetic splitter may specifically include an engagement lever system that may rely on tension via position rather than force. This engagement lever system may supply tension to belts of the kinetic splitter that may in turn drive a push plate or ram forward, and then automatically disengage from the system at the end of the stroke.

FIGS. 1-25 illustrate various views of a kinetic splitter and components thereof in accordance with various embodiments.

In various embodiments, the pinion 004 may be driven by a belt drive system. A driven sheave 006 is attached to the end of the pinion 004 such that rotation of the driven sheave 006 causes the pinion 004 to rotate.

In various embodiments a belt drive system may comprise a driven sheave 006, a drive sheave 008, an idler 009, and a belt 005. A belt 005 may have a cross-sectional shape that is rectangular, trapezoidal, triangular, round, or any other suitable shape. In embodiments, the drive sheave 008 may have a diameter of at least four inches. In some embodiments, the drive sheave 008 may have a diameter that is between approximately 25% and approximately 100% of the diameter of the driven sheave 006. The ratio between the drive sheave 008 and the driven sheave 006 may allow the flywheel 007 to rotate at a maximum kinetic energy while the pinion 004 rotates at a relatively slower speed. As a result, this configuration may optimize the process of splitting a log 031 in a controlled manner.

In various embodiments a belt system is held loosely around the driven sheave 006 and the drive sheave 008. A drive sheave 008 may be mounted to a rotating inertial mass, for example, a flywheel 007. Such a rotating inertial mass is caused to rotate by means of a motor/engine 010. The flywheel 007 may be caused to rotate by motor 010 by use of a belt system or by a toothed gear-drive system, or by direct connection between the flywheel 007 and the motor 010. The inertial mass is of sufficient size and weight, and may be rotating at a sufficient speed to provide enough rotating kinetic energy that a rack and pinion system could provide enough force to a log 031 that it would split against a wedge 002. In embodiments, the engine may be a gasoline combustion engine, a propane combustion engine, a diesel combustion engine, an electric powered motor, a hydraulic powered motor, a power takeoff drive system, or some other type of motor/engine 010.

In various embodiments, idler 009 is placed at the perimeter of the loop formed by a loose-fitting belt 005. The idler 009 may be pressed into the back side or outside perimeter of a loose-fitting belt 005 such that the perimeter of the belt 005 is pushed toward the centerline that exists between the centers of the driven sheave 006 and the drive sheave 008. A two-sheave belt system has a tension side and a slack side. The slack side of the belt 005 exists on the side where the belt 005 is moving away from the driven sheave 006, and toward the drive sheave 008. A belt 005 is primarily effective at transmitting force through tension on belt 005. It does not effectively transmit force through compression. For this reason, tension may be added to the belt drive system through an idler 009 by adding tension to the slack side of the belt 005 with very little force back against the idler 009. There may be much less force needed to maintain a belt tension when it is applied to the slack side of a drive system.

In various embodiments, an idler 009 is attached to an actuation linkage that allows an operator to control the position of the idler 009. The actuation linkage may be attached to an actuator 012, such as a handle or button, that an operator can control.

An actuation linkage may be used that will stay in an actuated state or latch after an initial actuation is performed. This latch system may utilize a two-bar over-center linkage 015. A first bar 023 is connected to an actuating handle, lever, or button and is attached to a rigid structure by a first pin 020 that allows the first bar 023 and an actuator 012 to rotate about a first pin 020. A second bar 024 exists that is connected on one end to the first bar 023 through a second pin 021, and on the other end is connected to a horizontally mounted compression spring 025 through a third pin 022. The first bar 023 and the second bar 024 may be connected, via the second pin 021, in such a way that an angle exists between the first bar 023 and the second bar 024. The compression spring 025 attached to the second bar 024 is applying pressure in a way that causes the third pin 022 to move closer to the first pin 020, and causes the second pin 021 to move away from a centerline that can be drawn between the first pin 020 and third pin 022. To utilize the latch system, rotation is applied to the first bar 023 through the handle that causes the second pin 021 to rotate to the point that it is close to the centerline between the first pin 020 and the third pin 022. Once the second pin 021 reaches a point where it has rotated beyond the point where it is aligned with the first pin 020 and third pin 022, the compression spring 025 continues to force past the aligned position. The actuator 012 remains in an actuated state until it is forced back in the opposite direction.

Various embodiments may attach the actuator 012 of an over-center linkage 015 to a pivoting arm 013 that causes the idler 009 to tighten the belt 005 when in an actuated state. The compression spring 025 used must apply sufficient force to hold the mass of the idler 009 away from the belt 005 in an actuated state, but apply enough force to the idler 009 during actuation to provide enough tension to the belt drive system to effectively split wood.

As described in greater detail below, various embodiments of the kinetic log splitter may include an actuator 112 that may actuate a disengaging linkage 131, which may in turn force a handle linkage system 135 into an over-center relationship with an idler mounting arm 113. In this configuration, the idler mounting arm 113 may therefore apply sufficient tension to the drive belt system to split wood.

Various embodiments utilize an over-center release mechanism to disengage the idler 009 at the end of travel. Various embodiments permit a part of the over-center latch 026 to rest along the side face of the rack 003. At the end of travel for the rack 003, a release pin 019, mounted in the side of the rack 003, pushes on the bottom of the rack linkage, disengaging the over-center linkage 015. In a different embodiment, the second pin 021 over the over-center linkage 015 rests along the top surface of the rack 003. A wedge 002 mounted to the top of the rack 003 forces the second pin 021 to move back to the unactuated state.

In various embodiments a retraction spring 011 is placed on the ram 001 and attached to the frame of the splitter. Once the idler 009 has been disengaged, the retraction spring 011 pulls the ram 001 and rack 003 back to the retracted state until the next actuation. It will be noted that although the ram 001 is depicted as an anvil, in other embodiments the ram 001 may be a wedge, such as a push plate discussed below.

In various embodiments bumpers 032 are used at the end of travel to help stop the ram 001, rack 003, pinion 004, and driven sheave 006. Because all of these components have significant inertia, compression springs may be used for the bumpers 032. The springs may be used to store potential energy, and provide additional force to assist the ram 001 slowing then reversing.

In some embodiments, one or both of the retraction spring 011 and/or the bumpers 032 may be configured to allow splitting power to be maintained as long as possible while shortening the cycle time of the splitting process. Specifically, the rack 003, and specifically the ram 001, may be required to decelerate (e.g., disconnect power from the flywheel), stop, and return to a "home" position. In some embodiments, the rack 003, and specifically the ram 001, may be required to decelerate and/or stop before the ram 001 physically hits the wedge 002. In some embodiments, the rack 003, and specifically the ram 001, may be required to decelerate and/or stop when the ram 001 is within approximately an inch of the wedge. In some embodiments, the rack 003, and specifically the ram 001, may be required to decelerate and/or stop when the ram 001 is within between one and a half inches and half an inch from the ram. The use of the bumpers 032 and/or the retraction spring 011 may allow the rack 003 and ram 001 to decelerate in as short a space as possible. The retraction spring 011 and/or the bumpers 032 may also aid the return of the rack 003 and the ram 001 to a "home" position after a full stroke, which may reduce the time of a splitting cycle.

An example process of decelerating, stopping, and reversing the rack 003 and/or ram 001 may be as is described in the following enumerated elements. Specifically, the bumpers 032 and/or retraction spring 011 may be configured to absorb the energy of the ram 001, compress the bumpers 032 and/or retraction spring 011, and allow the ram 001 to get within approximately 0.25 inches to one and a half inches of the wedge 002 (for a full split) without a sudden stop to the ram 001 and/or rack 003.

1) The ram 001 may contact the bumpers 032 and begin initial compression of the bumpers 032. In other embodiments the retraction spring 011 may start to stretch which may generate a force similar to the compression of the bumpers 032. During this time, the kinetic splitter may be actively splitting wood, and the ram 001 may be approximately one and a half inches from the wedge 002.

2) The belt drive system may disengage the flywheel 007 from the ram 001, rack 003, pinion 004, and driven sheave 006. During this time, the ram 001 may be approximately one inch from the wedge 002.

3) The bumpers 032 and/or retraction spring 011 may absorb the inertia of the ram 001, rack 003, pinion 004, and/or driven sheave 006 as the system comes to a stop. At this time, the ram 001 may be approximately 0.4 inches from the wedge 002.

4) The bumpers 032 and/or retraction spring 011 may release their stored energy to send the ram 001, rack 003, pinion 004, and/or driven sheave 006 back to the starting "home" position.

In some embodiments the kinetic splitter may further include a dampener system (not shown) mounted at the home position of the ram 001. This dampener system may be similar to or the same as elements of the bumpers 032 and/or retraction spring 011. The dampener system may be configured to absorb the inertia of the ram 001, rack 003, pinion 004, and/or driven sheave 006 while the ram 001 is returning to its home position. The ram 001 may be returning to its home position at a speed of approximately 30 inches per second, though in other embodiments the ram may be moving at a different rate of speed.

In various embodiments the rack 003 takes the form of a rectangular beam with teeth 027 that are centered on a side. The teeth do not span the full width of the rectangular beam, leaving two coplanar flanges on either side of the teeth 027. Rack teeth 027 are configured to engage with pinion teeth 028.

In various embodiments the rack 003 is supported on both the top and bottom. The bearings 018 on the bottom are concentric with the pinion shaft and the outer circumference of these bearings rides on the flanges on either side of the rack teeth 027. Two bearings 014 are centered on the side 030 of the rack 003 that is opposite the side 029 that has teeth 027. The bearings 014 are spaced so that one bearing lies in front of the pinion 004 closer to the wedge 002 and the other lies behind the pinion 004 closer to the rear of the splitter. The two bearings that are collinear with the pinion are used to set the proper engagement distance. The two bearings on the opposite side are used to resist the tendency of the rack 003 to disengage when a force is applied horizontally on the end of the rack 003, perpendicular to the center axis of the pinion 004.

In various embodiments a belt support 017 may be used to support the tension side of the belt system when it is in an unactuated, loose-fitting state. The support may be a piece of material that is mounted a small distance below and parallel to the tension side of the belt 005 when it is under tension. The guard may also follow the contour of the driven sheave 006 and drive sheave 008 to no more than a point that the support would be horizontal from the center point of each respective sheave. These support pieces may control ballooning of the belt 005 when it is not under tension, allowing it to be held up out of the grooves of the driven sheave 006 or the drive sheave 008. Supporting a belt 005 in such a manner allows the driven sheave 006 and the belt 005 to remain stationary in the unactuated state while the drive sheave 008 continues to rotate. It also allows the driven sheave 006 to be able to rotate backward while the rack 003 and ram 001 are retracting.

In various embodiments a pin 016 is placed on the arm 013 used to actuate the idler 009 that is positioned just below the belt 005. When the belt 005 is disengaged, this pin 016 pulls up on the slack side of the belt 005 to disengage it from the grooves of the sheave. Under heavy loads, the belts may become lodged in the grooves of the sheave.

Figure 8:
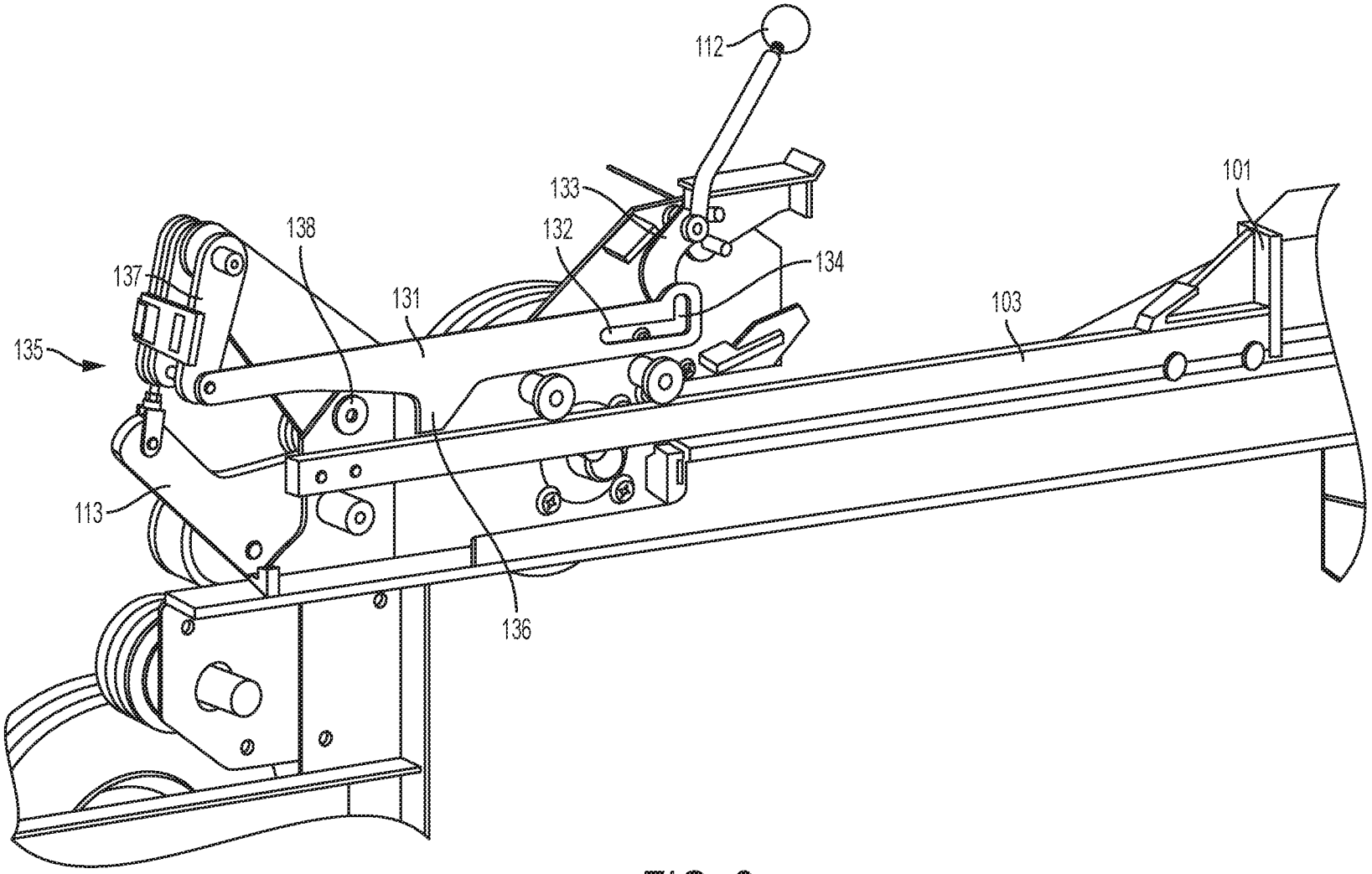
FIG. 8 illustrates a view of a handle linkage mechanism of a kinetic splitter and components thereof, in accordance with various embodiments.

FIG. 8 depicts an alternative embodiment of a kinetic splitter that may include a handle linkage system 135. The embodiment of the kinetic splitter depicted in FIG. 8 may have elements that are similar to similarly numbered elements of FIGS. 1-7B. Specifically, the kinetic splitter depicted in FIG. 8 may include a rack 103, a ram 101, an actuator 112, and an idler mounting arm 113 that may be respectively similar to the rack 003, ram 001, actuator 012, and pivoting arm 013 described above. The kinetic splitter depicted in FIG. 8 may include further elements such as a pinion, etc. that are not specifically enumerated in FIG. 8 for the sake of clarity.

The handle linkage system 135 may be configured to allow an operator to hold the actuator 112 in a splitting position at the end of the stroke cycle without the force of the rack 103 abruptly forcing the actuator 112 to the disengaged position. The operator may continue to hold the actuator 112 in the engaged position while the machine resets and prepares for a second splitting action, without damage to the operator and/or the machine.

Specifically, in the embodiment depicted in FIG. 8, the actuator 112 may be coupled with an arm 133 that includes a pin 134 on the end. The pin 134 may be configured to go into a cutout portion 132 of a disengaging linkage 131. At the end of the stroke, a cam 138 mounted to the end of rack 003 may follow the contour 135 on the bottom of the disengaging linkage 131, which may lift the cutout portion 132 such that the pin 134 may be released from the notch in the cutout portion 132. This action may release the actuator 112 from an active role in the handle linkage system 135. Further, the counter 136 of a disengaging linkage 131 may be made such that it changes from a primarily horizontal surface to a primarily vertical surface, which may allow the cam 138 to push the disengaging linkage 131 forward, thus pulling the pivot linkage 137 and pivoting arm 113 out of their over-center alignment, and allow the belt idlers to move, thereby releasing tension in the belt system. This release of tension in the belt system may disengage power to the rack 103.

Figure 9A:
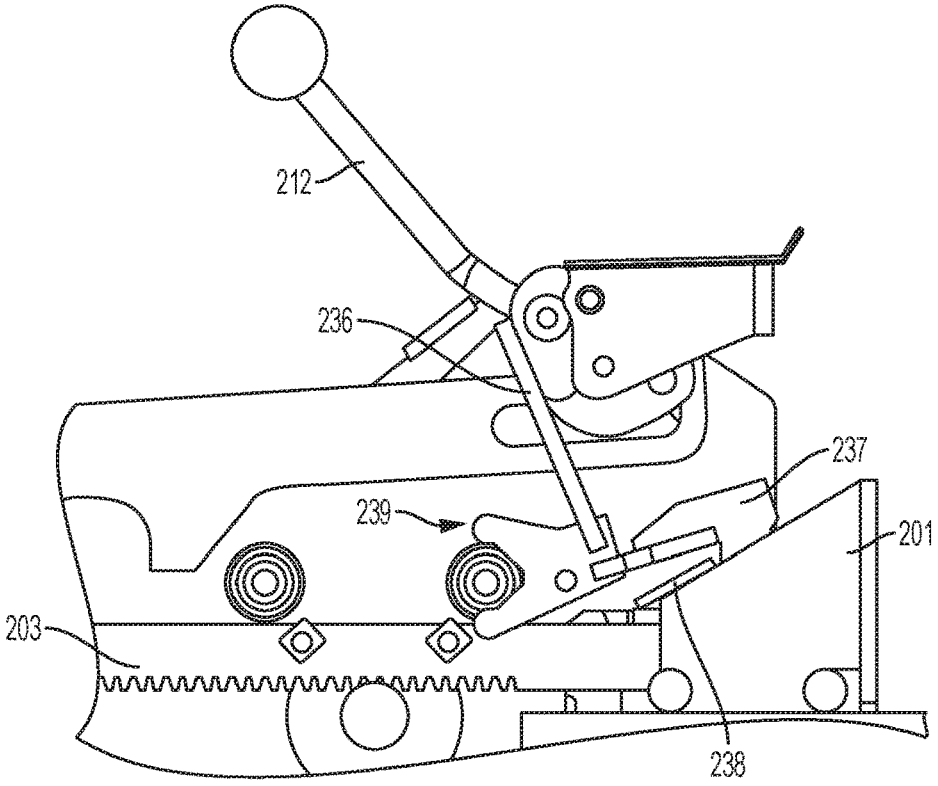
FIG. 9A illustrates a first view of a push plate lock of a kinetic splitter and components thereof, in accordance with various embodiments.
Figure 9B:
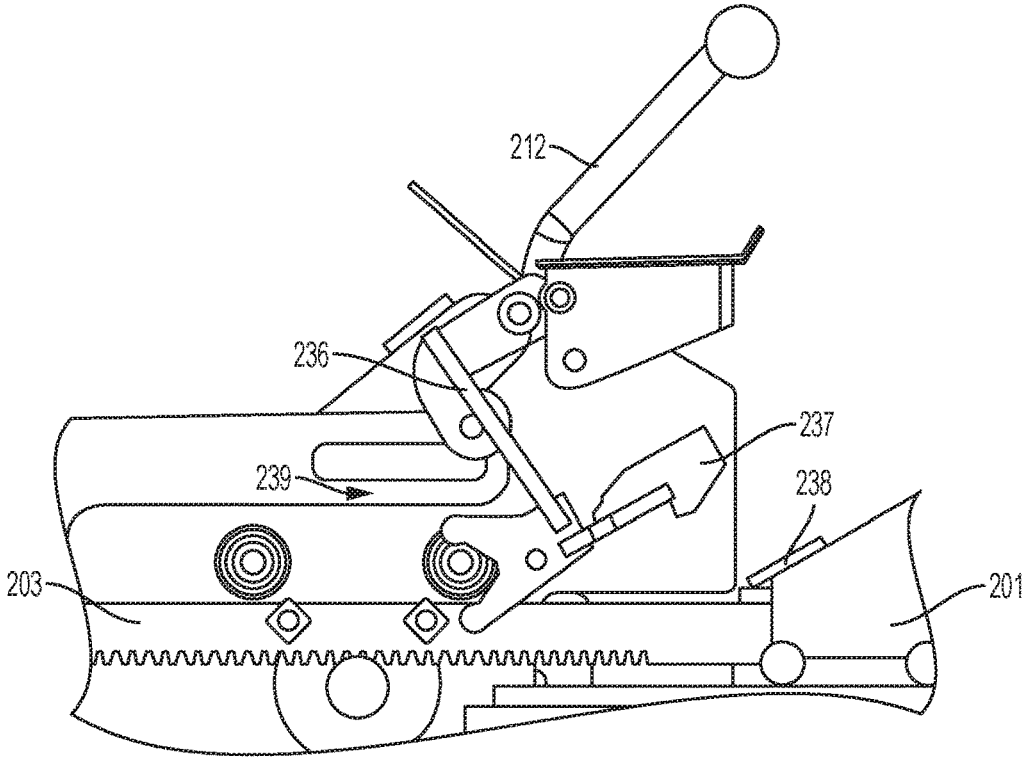
FIG. 9B illustrates a second view of a push plate lock of a kinetic splitter and components thereof, in accordance with various embodiments.

FIGS. 9A and 9B depict an alternative embodiment of a kinetic splitter that may include a ram lock 239 that may prevent the ram from moving unless the actuator is moved forward by the user. The embodiment of the kinetic splitter depicted in FIG. 9 may have elements that are similar to similarly numbered elements of FIGS. 1-7B. Specifically, the kinetic splitter depicted in FIG. 9 may include a ram 201, a rack 203, and an actuator 212 that may be respectively similar to the ram 001, rack 003, and actuator 012 described above. The kinetic splitter depicted in FIG. 9 may include further elements such as a pinion, etc. that are not specifically enumerated in FIG. 9 for the sake of clarity.

In some embodiments, the ram 201 may include a protrusion 238. The ram lock 239 may include a locking mechanism 237 configured to mate with the protrusion 238. The ram lock 239 may further include an arm 236 that is in physical connection with the actuator 212. When the actuator 212 is moved, the movement of the actuator 212 may cause the arm 236 to be rotationally or laterally displaced, which in turn may cause the ram lock 239 to rotate. When the ram lock 239 rotates, the locking mechanism 237 may disengage with the protrusion 238 as shown in FIG. 9B.

The embodiments described below in reference to FIGS. 10-25 provide further example embodiments of a kinetic log splitter, in addition or in the alternative to embodiments described in reference to FIGS. 1-9.

Figure 10:
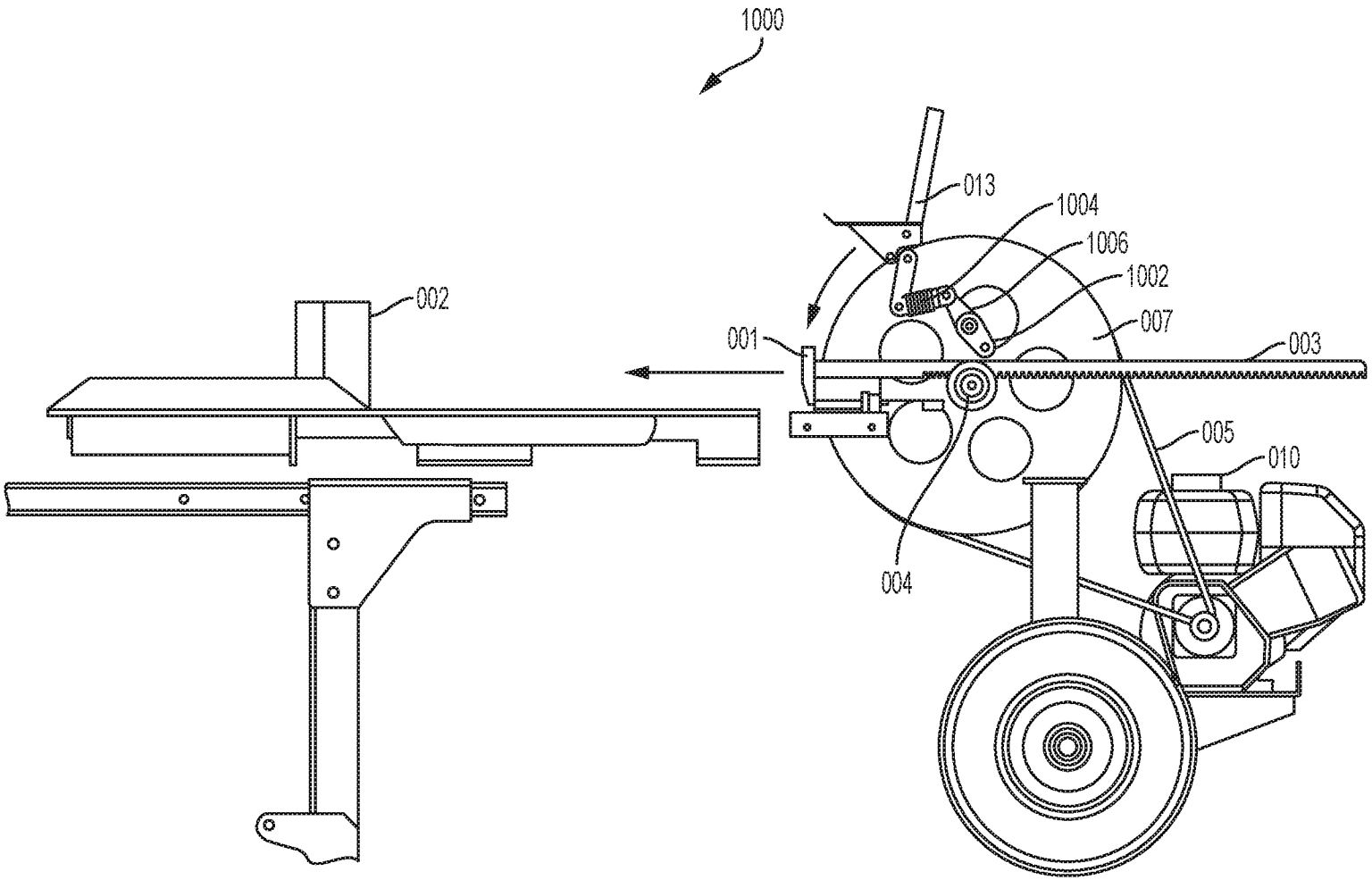
FIG. 10 illustrates an example embodiment of a kinetic log splitter in accordance with various embodiments.

FIG. 10 illustrates an example embodiment of a kinetic log splitter 1000 in accordance with various embodiments. For simplicity purposes, the like elements are designated by like numerals. A gas or electric motor 010 rotates a flywheel or flywheels 007 that are mounted on a gear pinion 004. The pinion 004 in turn is mounted in bearings (not shown) that are secured to the main body or frame of the log splitter 1000. In a non-actuated state the flywheel 007 rotates to generate stored energy. When an operator pulls the actuation handle 013 forward (counter clockwise) it moves the mid-link 1004 in the opposite direction. The mid-link 1004 in turn rotates the over center linkage 1006 clockwise causing the engagement bearing 1002 to contact the top of the rack 003 which forces the free floating rack 003 downward thus engaging teeth with the pinion 004 and forcing the rack 003 outwards in the direction of the arrow. The engagement bearing 1002 and over center linkage 1006 rotates (e.g., slightly) over center to the rack 003 securing the rack 003 in this position. The rack 003 is connected to a push plate 001 that contacts and forces a log (not shown) down the length of the beam (not shown in this view) in the direction of the arrow until the log contacts a splitting wedge 002 causing the log to split into sections. At the end of the rack 003 is a steep chamfer that drops below the bearing 1002 causing the over center linkage 1006 to rotate back to the non-actuated state. The flywheels 007 regain any rotational speed that may have been lost in the split and the unit is ready for another log. This explains the basic operation on wood that can be split by the energy of the machine 1000.

There may be occasions that a log cannot be split on a single try or even multiple attempts. When the push plate 001 and rack 003 are suddenly stalled by a log, the energy from the flywheel(s) 007 may continue to exert force to the pinion 004 and ultimately to the rack 003. In certain log splitters, several situations may occur in this moment: first, the engine/motor 010 may stall releasing tension on the rack 003; second, if a centrifugal clutch/pulley is used on the engine 010 the slower rotation of the flywheels 007 may disengage the clutch releasing tension on the rack 003. The above situations can be eliminated or reduced using the improved linkages provided here.

Figure 11:
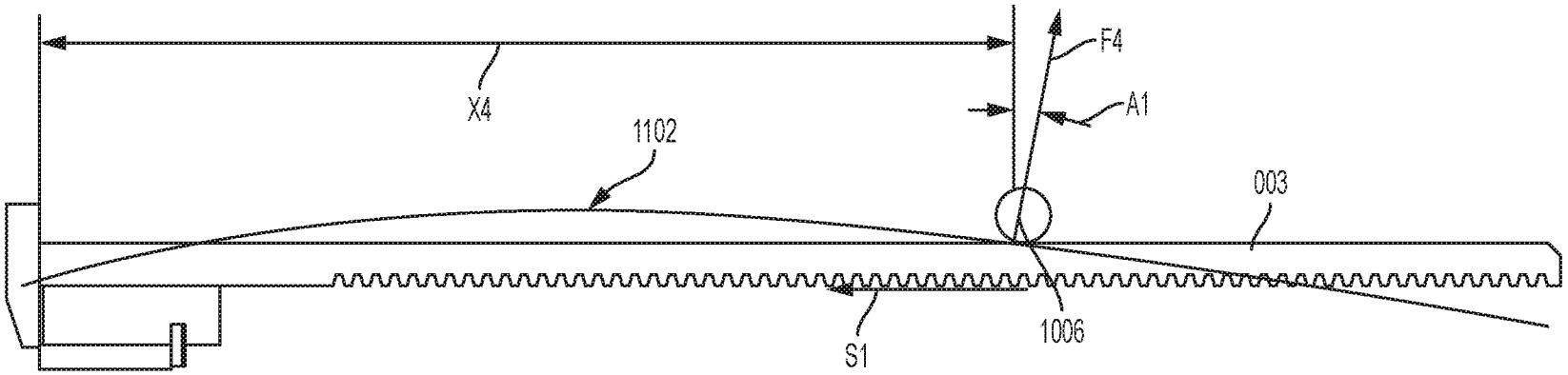
FIG. 11 illustrates a bow effect on a rack of a kinetic log splitter, in accordance with various embodiments.

Another undesirable and potentially dangerous situation is depicted in FIG. 11, which illustrates a bow effect on a rack of a kinetic log splitter, in accordance with various embodiments. In FIG. 11 $X_4$ equals the distance between rack/push pivot point and the over center bearing centerline. $A_1$ equals the angle between vertical line and normal rack force applied to center arm bearings (the force applied normal to the top of the rack, for example a bowed rack). $S_1$ equals the horizontal force applied to the rack. $F_4$ equals the normal rack force applied to the over center arm bearings. The critical effect is when the energy forces the rack 003 to bow (as illustrated by numeral 1102 in FIG. 11) and the bow creates an angle $A_1$ greater or equal to the amount of over center angle that the over center linkage 1006 is designed to hold. This may force the linkage 1006 to violently release with several thousand pounds of energy, of which some is transferred to the handle 013. There may be enough energy and speed of the handle 013 release to cause injury to the operator if he/she is in contact with or in close proximity to the handle 013. To mitigate the potentially dangerous situation described above, improved linkages have been developed and are disclosed herein.

Figure 12:
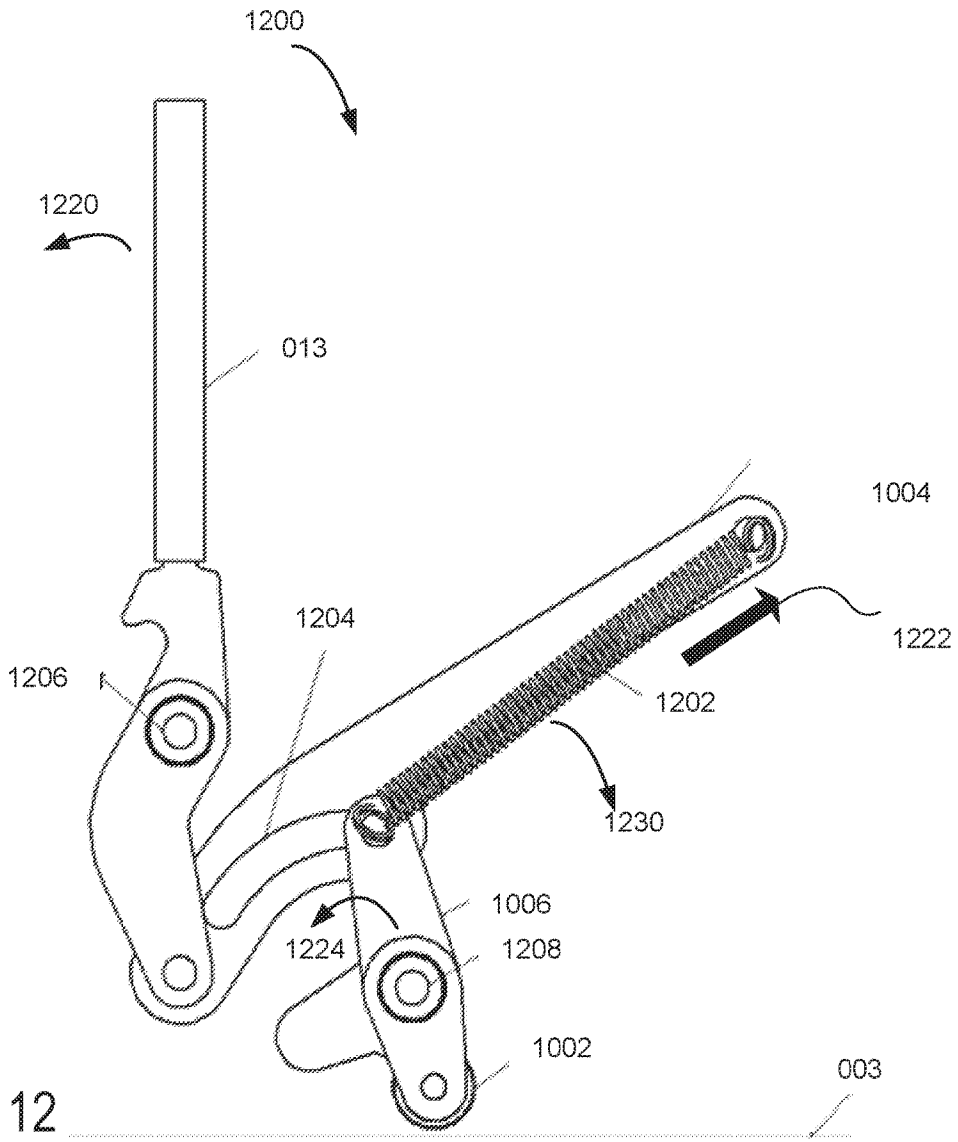
FIGS. 12-16 illustrate example embodiments of a linkage configured to allow a disengagement of at least a portion of the linkage system in response to a stall condition that may occur in a kinetic log splitter, in accordance with various embodiments.

FIGS. 12-16 illustrate example embodiments of a linkage configured to allow a disengagement of at least a portion of the linkage system in response to a stall condition that may occur in a kinetic log splitter, in accordance with various embodiments. FIG. 12 illustrates an example linkage system 1200 of a kinetic log splitter, in accordance with some embodiments. The mid-link 1004 may be modified to keep constant tension on the over center linkage 1006 through a tension component or kinetic energy absorption component, such as tension spring 1202. When the handle 013 is actuated counter clockwise 1220 around a first pivot point 1206, the mid-link 1004 may move to the right (clockwise 1230) and the force 1222 of the tension spring 1004 pulls the over center linkage 1006 into the over center position (around the second pivot point 1208) forcing the rack 003 downward engaging the pinion (not shown) and cycling the machine 1000. When a rapid stall occurs and the rack 003 may be bowed (e.g., past approximately 2°), the over center linkage 1006 may forcefully rotate counter clockwise 1224 and is allowed to rotate within the release slot 1204 without transferring significant energy into the handle for example should the force exceed the force needed to extend the tension spring 1202. Once the rapid rotation of the over center linkage occurs, the tension spring 1202 may return the over center linkage 1006 to its rearward position and is ready to be actuated again.

Figure 13:
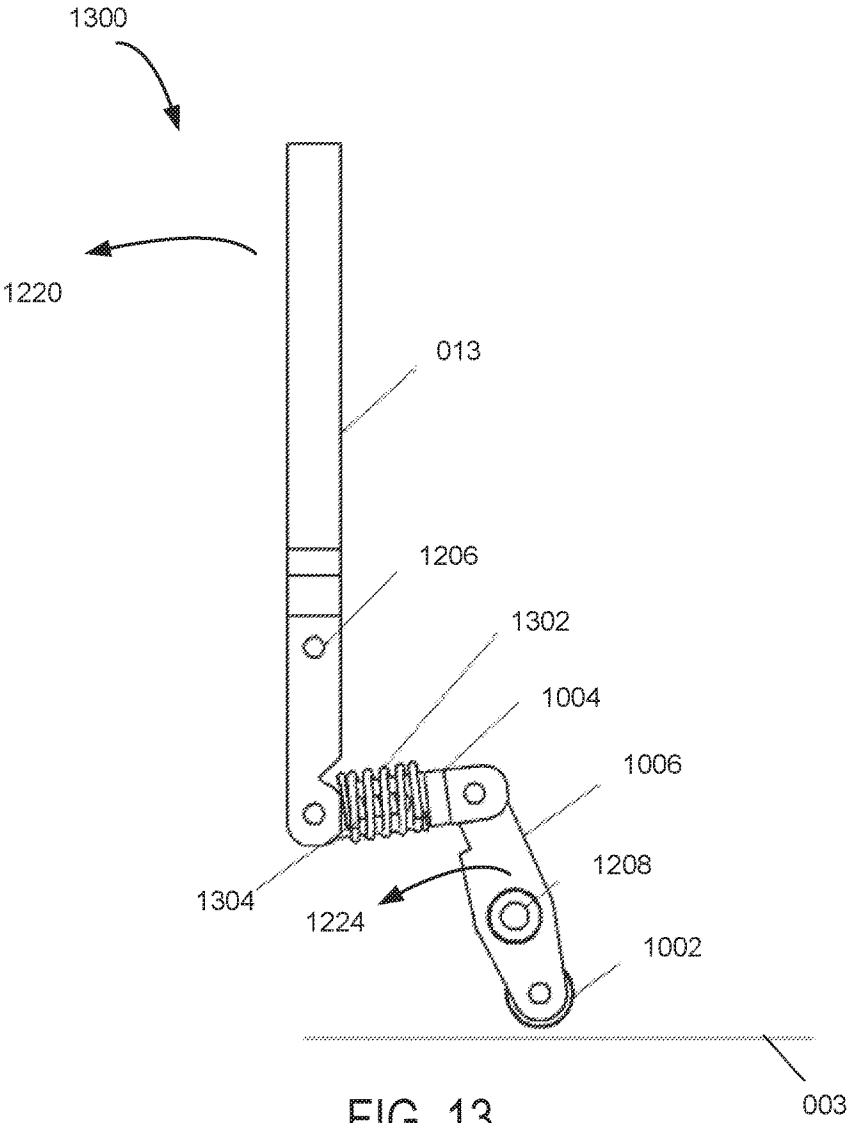

FIG. 13 illustrates another example linkage system 1300, in accordance with some embodiments. As shown, the linkage system 1300 may include a compression spring 1302 disposed in the mid-link 1004. When the handle 013 is actuated counter clockwise 1220 around the first pivot point 1206, the compression spring 1302 may force the over center linkage 1006 into the over center position, as shown. When a stall occurs, the over center linkage 1006 may rotate (e.g., rapidly) counter clockwise 1224 around the second pivot point 1208, overcoming the force of the compression spring 1302. The compression spring 1302 compresses forcing the mid-link 1004 to slide past the handle connection through the release slot 1304. Upon energy release of the over center linkage 1006 the compression spring 1302 returns to its extended length and the actuation cycle is complete.

Figure 15:
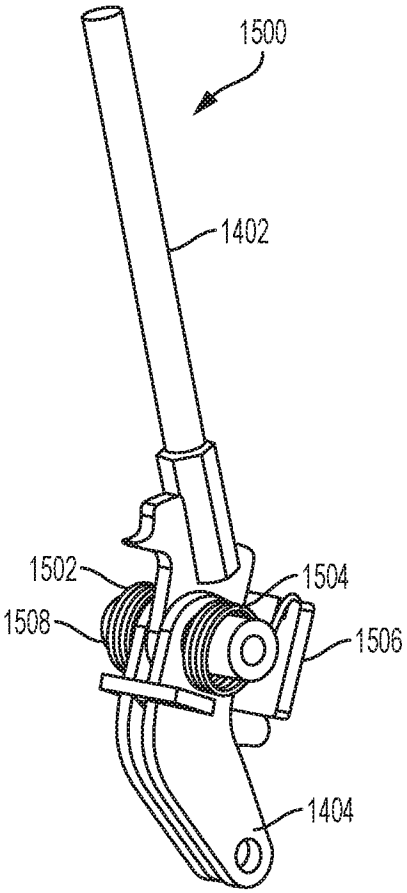
Figure 14:
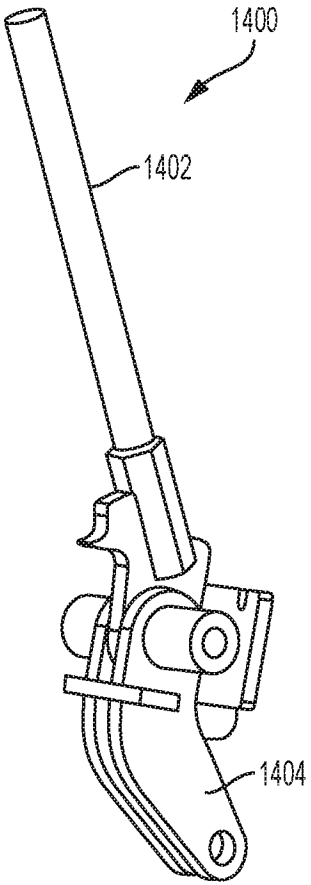

FIGS. 14 and 15 illustrate example embodiments of a handle of the linkage system, in accordance with some embodiments. As shown, a handle 1400 may be made of two sections 1402 and 1404 attached in such a manner that section 1402 is allowed to pivot about section 1404. Both sections 1402 and 1404 may rotate freely about the other, for example about a pin disposed between the two plates of section 1404 that passes through a hole in the lower end of section 1402. FIG. 15 shows the handle assembly 1500 similar to handle 1400, with two torsion springs 1502 and 1504 in place on the handle assembly 1500. Plate 1506 is a permanent part of the upper section 1402 and plate 1508 is a permanent part of the lower section 1404. The torsion springs 1502, 1504 may be placed into the handle assembly 1500, and they may exert a force on both plates 1506, 1508, constraining the two sections 1402, 1404 in a rigid manner. With force, the two sections 1402, 1404 may pivot about the other, but the assembly 1500 may act as a single part handle (e.g., 013).

Figure 16:
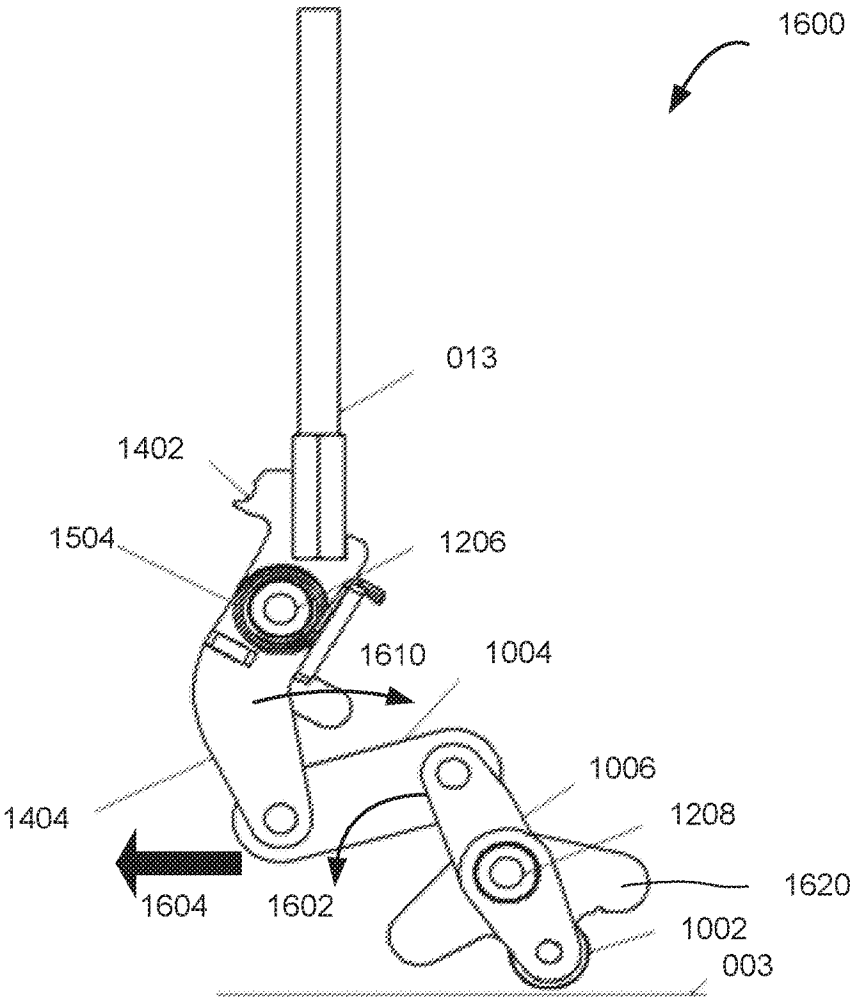

FIG. 16 illustrates an example linkage system 1600 having a handle assembly described in reference to FIGS. 14-15, in accordance with some embodiments. As described above, when the over center linkage 1006 is kicked out of position by a sudden stall, the over center linkage 1006 may rotate counter clockwise 1602, forcing the mid-link 1004 to move to the left, as indicated by arrow 1604. The mid-link 1004 may force the lower section 1404 in a short clockwise rotation 1610 and the majority of the energy (e.g., about 97%) may be absorbed by the two torsion springs 1502, 1504, so that the upper section 1402 and actuation handle 013 may encounter substantially no transferred energy effect.

In some embodiments, the over center linkage 1006 may include a lobe 1620, which may limit the travel of the over center linkage 1006. This lobe 1620 may be located such that it comes into contact with a fixed point (not shown) on the body of the machine. The relationship between the lobe 1620 and the fixed point on the machine may determine the amount of over center travel for the over center linkage 1006. The amount of over center travel may be critical to the functionality and durability of the linkage system 1600. Too little over center travel and the linkage system 1600 may not stay engaged during the split. Too much over center travel and the rack 003 and pinion teeth (not shown) may not be fully engaged and may shear. Limiting the over center travel directly at the over center linkage 1006, rather than at other points of the linkage system 1600 may reduce the tolerance stack up created during manufacture and wear during normal use.

In some embodiments, the over center linkage 1006 may include a lobe 1620 which may contact the rack 003 when the system 1600 is disengaged. The lobe 1620 may absorb the force of a sudden stall kickback and redirect a significant percentage of the energy back into the rack 003.

FIGS. 17-23 illustrate example embodiments of the kinetic log splitter 1000 with a towing unit, in accordance with some embodiments.

Figure 17:
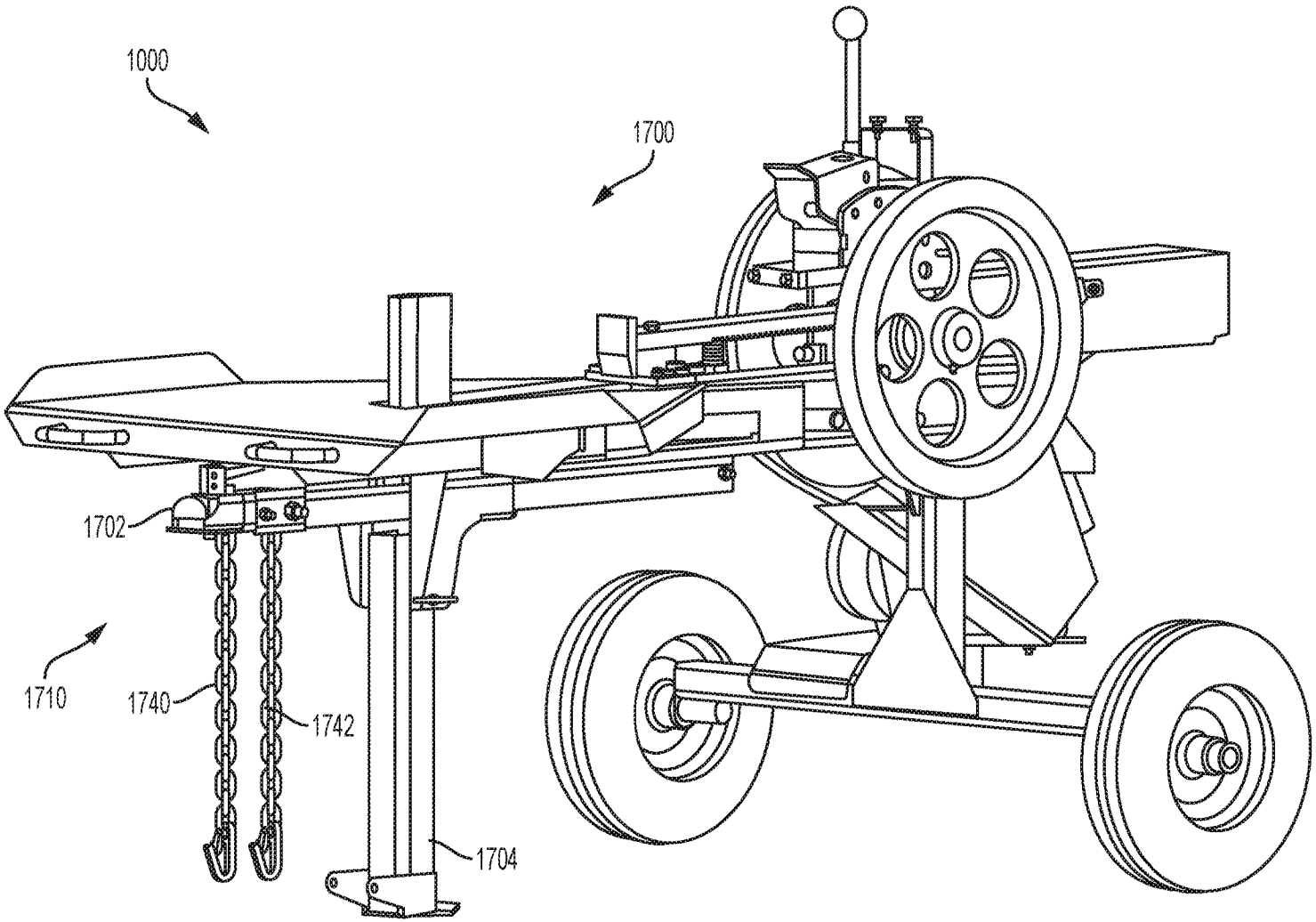
FIGS. 17-23 illustrate example embodiments of the kinetic log splitter with a towing unit, in accordance with some embodiments.
Figure 18:
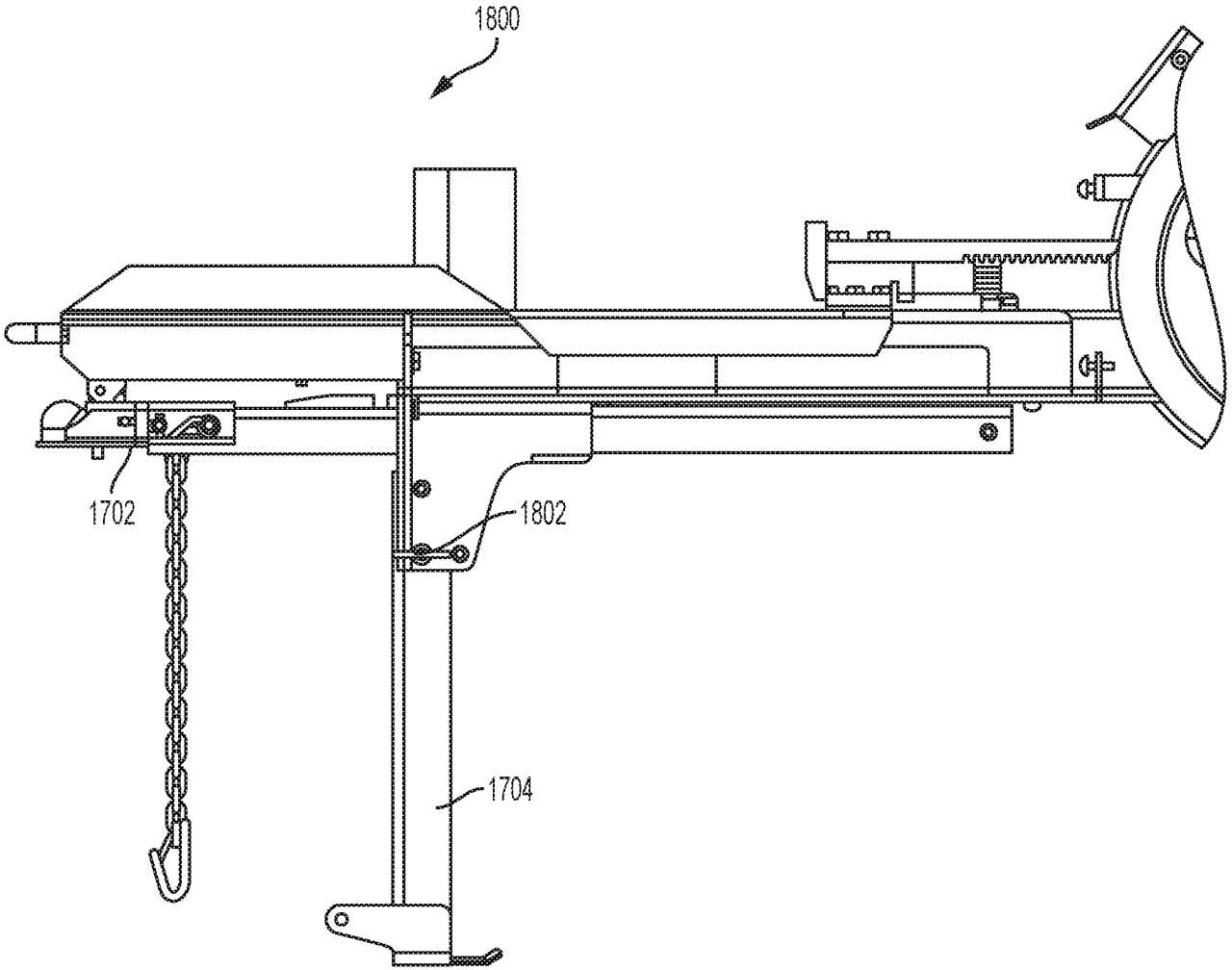
Figure 19:
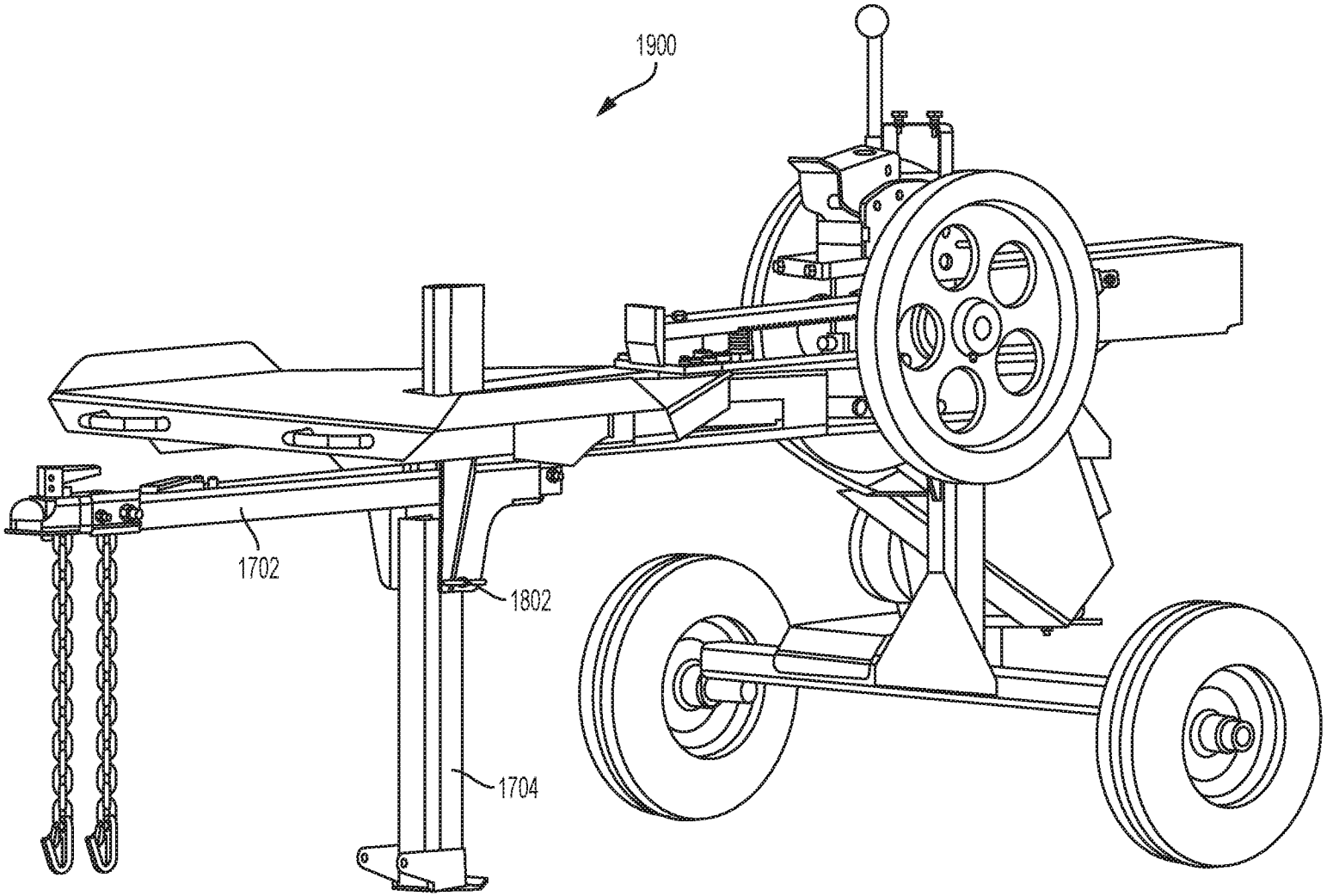
Figure 20:
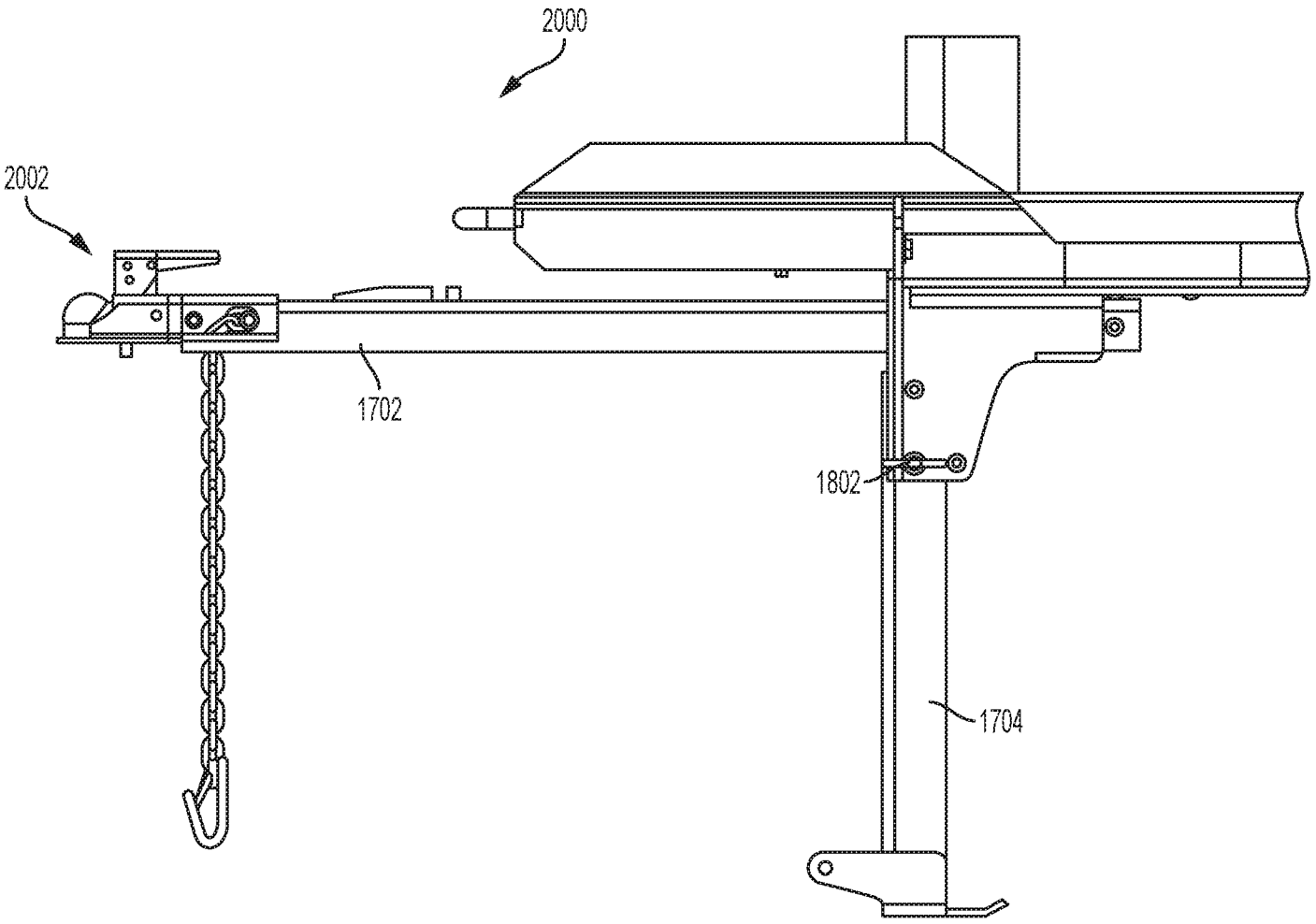
Figure 21:
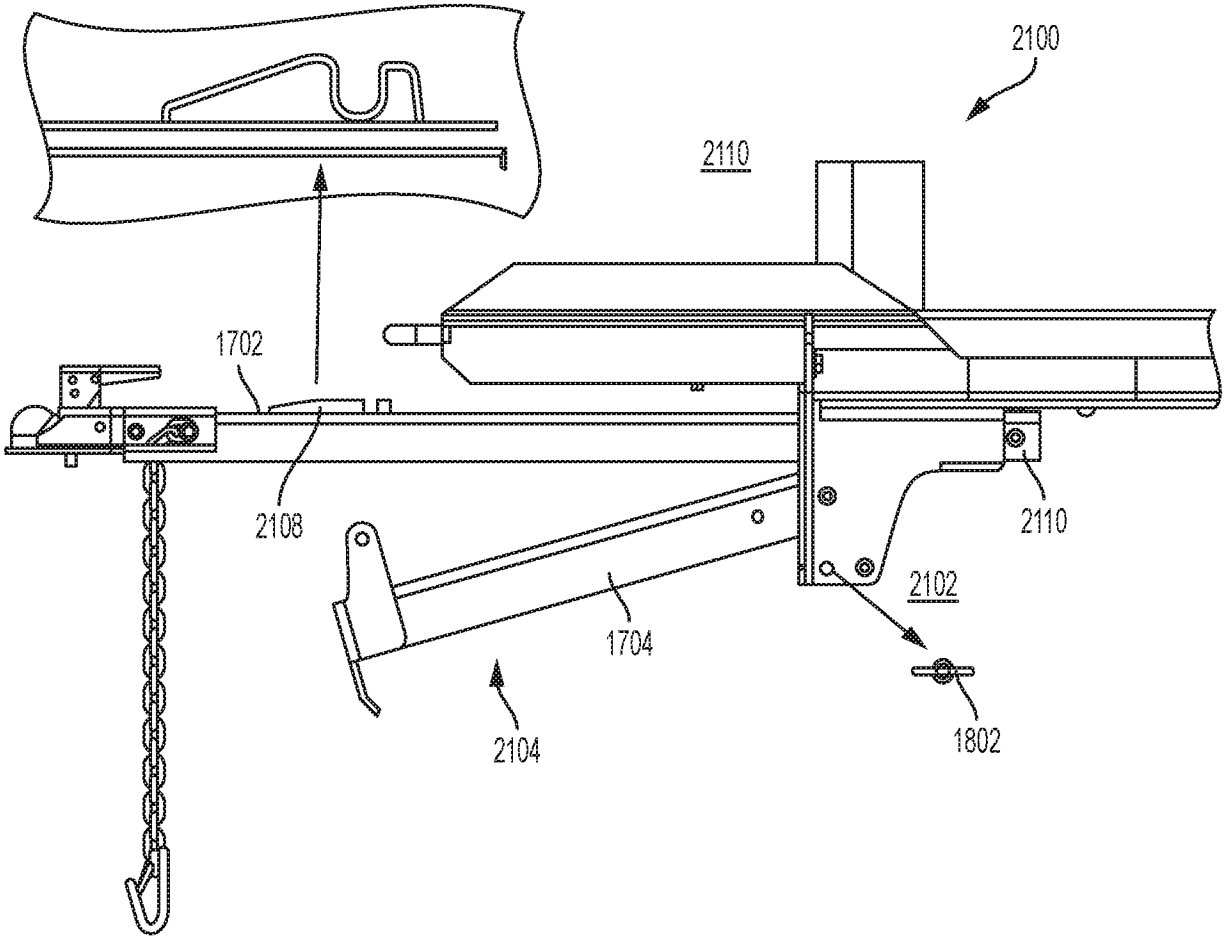
Figure 22:
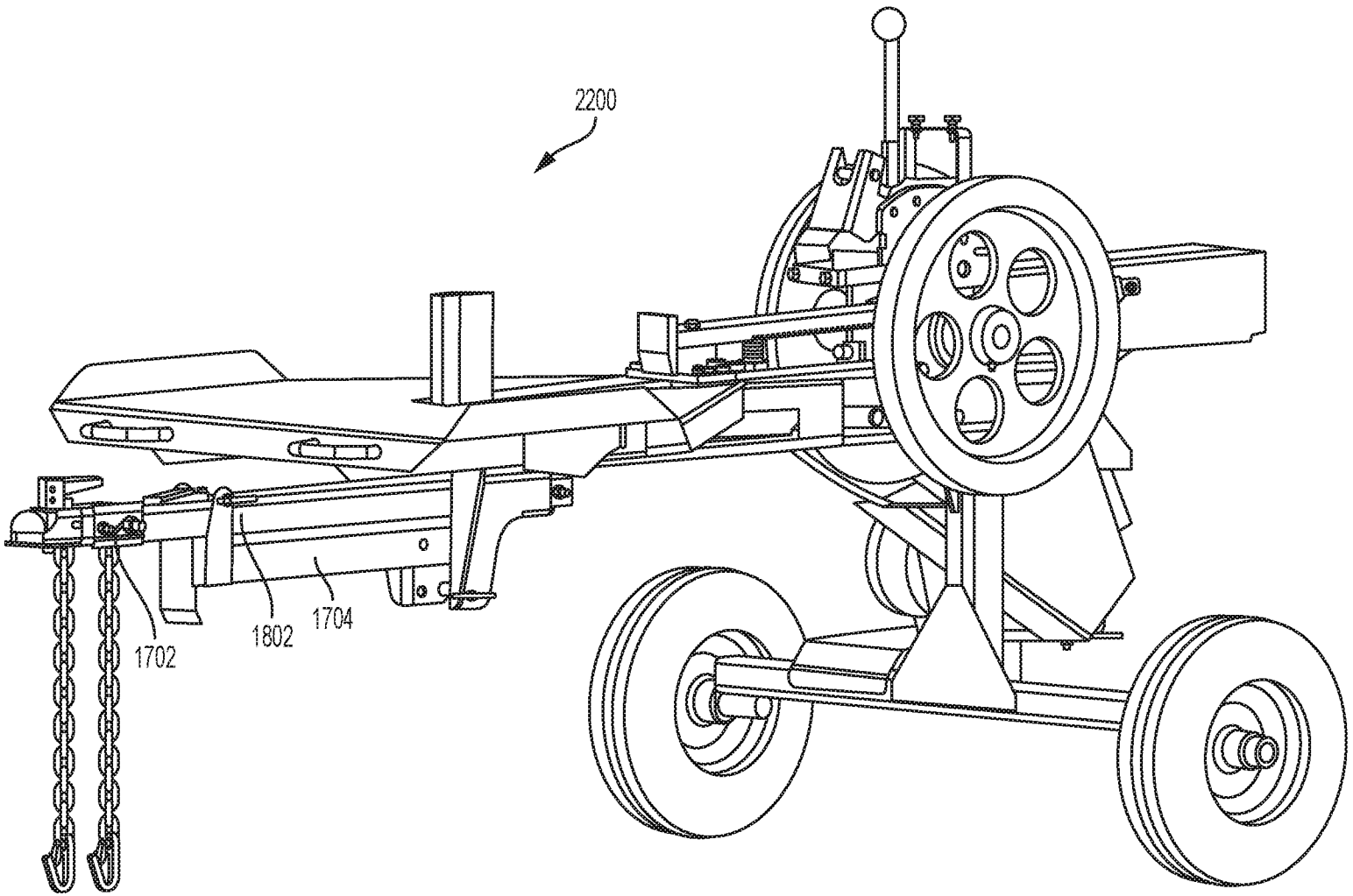
Figure 23:
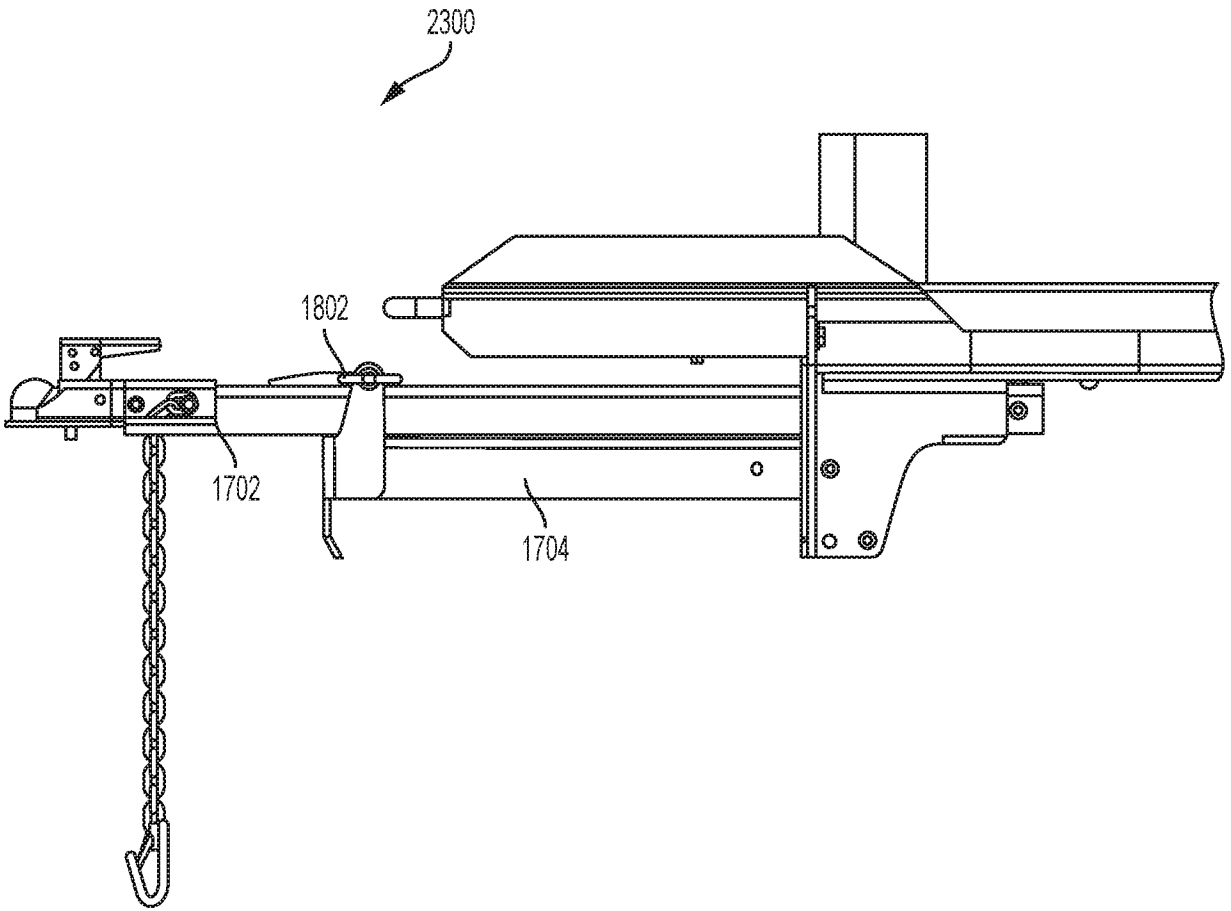

FIGS. 17-18 illustrate a three-dimensional view 1700 and a side view 1800 of the kinetic log splitter 1000 in a working configuration. FIGS. 19-21 illustrate three-dimensional and side views 1900, 2000, and 2100 of the kinetic log splitter 1000 in transition from working configuration to towing configuration. FIGS. 22-23 illustrate three-dimensional view 2200 and side view 2300 of the kinetic log splitter in a towing configuration.

As shown in FIGS. 17-18, the towing unit 1710 may include a tongue 1702 and a stand 1712. In a working configuration, the stand 1704 is brought down as shown to a vertical position, to support the kinetic log splitter 1000. As shown in FIGS. 17-18, the tongue 1702 may be retracted in a working configuration. In some embodiments, a single pin 1802 may be used to hold the stand 1704 in position for splitting (as shown in FIGS. 17-18) and the same pin 1802 may be used to hold the assembly in the towing configuration (shown in FIGS. 22-23). To convert the splitter 1000 from working (splitting) to towing configuration, the following steps may be used: extend the tongue 1702 (as shown in FIGS. 19-20); pick up the front of the towing unit 1710 (as shown by arrow 2002 in FIG. 20); remove the pin 1802 holding the stand 1704 in the vertical orientation (as shown by arrow 2102 in FIG. 21); fold the stand 1704 towards the end of the tongue 1702 (as shown by arrow 2104 in FIG. 21); place the previously removed pin 1802 in the footplate of the stand 1704 to lock the tongue 1702 into place (as shown in FIGS. 22-23); and attach the tongue 1702 to the tow vehicle for towing (not shown). Folding the stand 1704 forward may allow the operator to convert the unit 1702 without crawling underneath the unit.

The tongue 1702 may have a towing locator 2108 (expanded view of which is shown in FIG. 21) incorporated into it which prevents the operator from locking the stand 1704 to the tongue 1702 in the incorrect location. The towing locator 2108 may prevent a failure of the connection between the recessed end of the tongue 1702 and the log splitter 1000 from allowing the tongue 1702 to be completely pulled out of the splitter during towing. This may be disadvantageous since the tow safety chains 1740, 1742 (see e.g., FIG. 17) may be connected directly to the tongue and separation of the tongue 1702 from the splitter 1000 may cause the main body of the log splitter 1000 to become disconnected from the tow vehicle (not shown). In some embodiments, this structure 2108 may ensure that splitter 1000 remains connected to the tow vehicle even in the event of a single mode of failure of the stop bolt 2110 shown in FIG. 21.

The tongue and stand embodiments of a towing unit for a log splitter described in reference to FIGS. 17-23 may not be limited to kinetic log splitters. The described embodiments may be utilized on any mechanism where a retractable/extendable tongue is desired. It should be noted that the stand in the described embodiments is shown as a rigid stand; however, the described embodiments may also be utilized with an extendable stand or jack.

Figure 24:
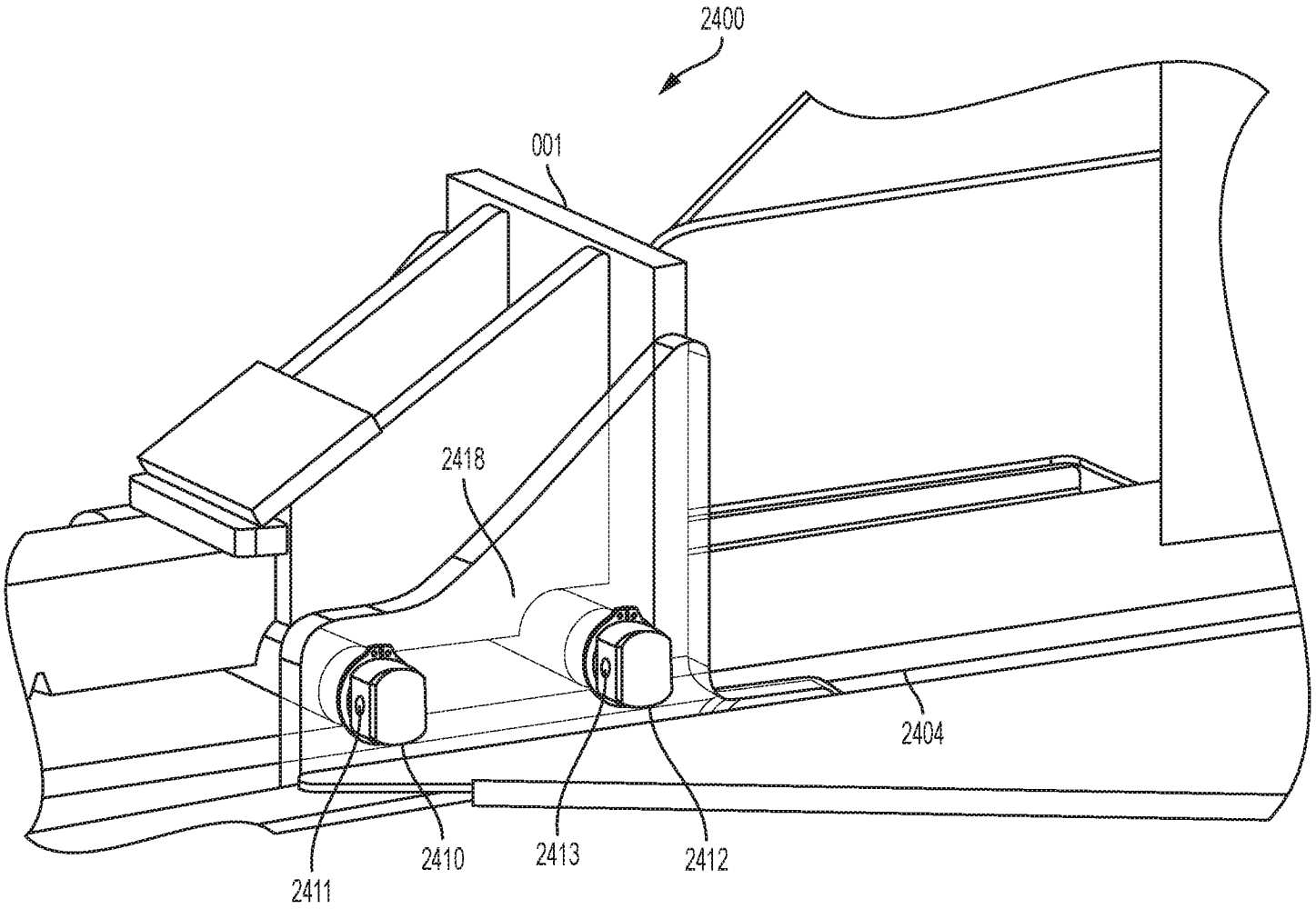
FIGS. 24 and 25 illustrates an example push plate splinter recovery system of the kinetic log splitter, in accordance with some embodiments
Figure 25:
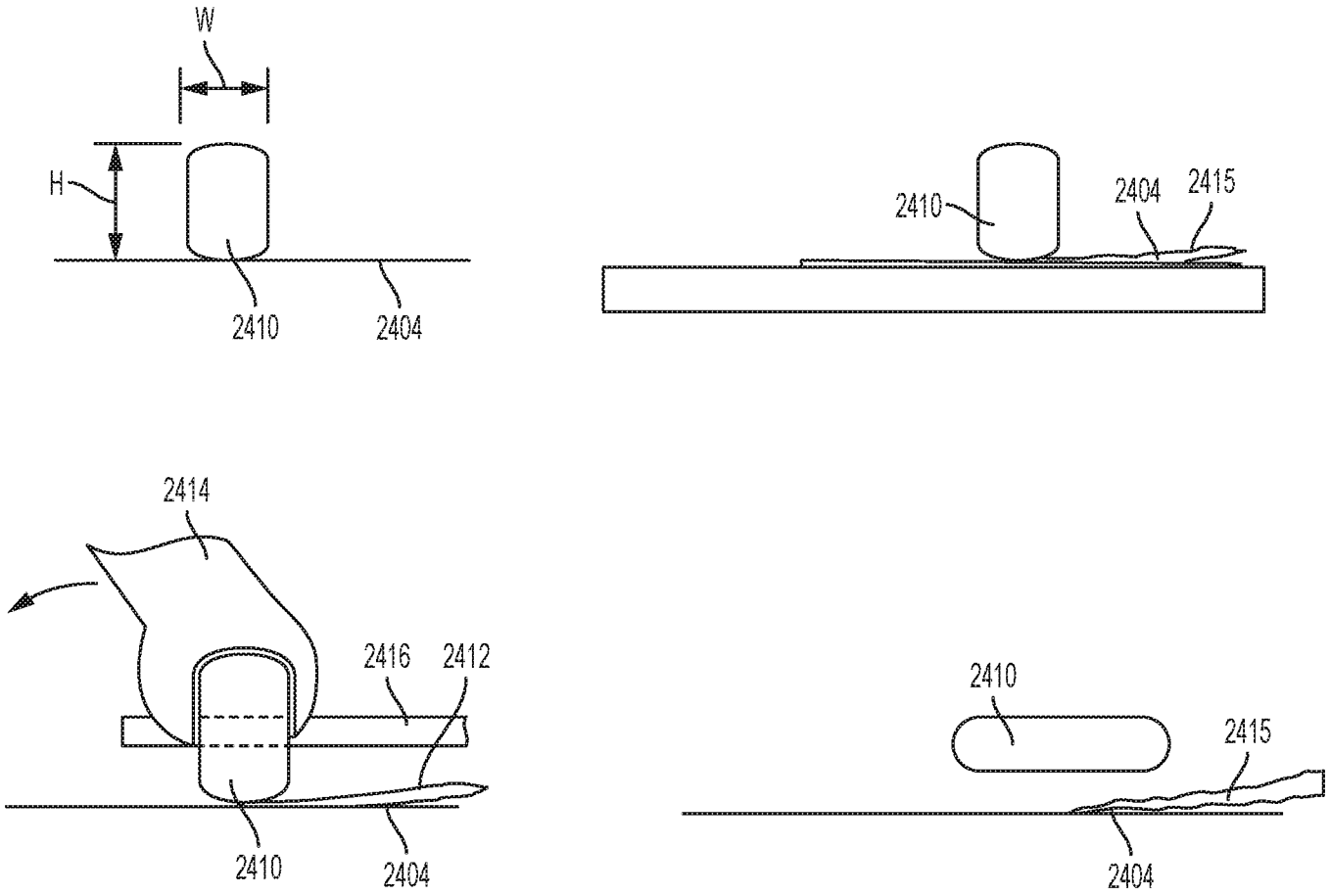

FIGS. 24 and 25 illustrate an example push plate splinter recovery system 2400 of the kinetic log splitter 1000, in accordance with some embodiments. The push splinter recovery system 2400 allows operator to remove splinters that may wedge between the push plate 001 and the beam 2404. This may occur several times a day (especially when splitting dry oak) and the traditional design requires that the operator loosen 3-4 bolts or nuts. The illustrated splinter recovery system 2400 allows the operator to turn pins 2410, 2412 (for example with a wrench 2414 or shaft 2416, such as a screw driver shaft, inserted into holes 2411 and 2413 as shown in FIGS. 24 and 25) to release a splinter 2415 as, shown in FIG. 25. As shown, the pin 2410, 2412 may have a an asymmetric structure, e.g., have a width W smaller than a height H, allowing for opening a space between the push plate 001 and the beam 2404 by a turn to a particular degree (e.g., by 90°), for example relative to a guide flange 2418.

Although certain embodiments have been illustrated and described herein, it will be appreciated by those of ordinary skill in the art that a wide variety of alternate and/or equivalent embodiments or implementations calculated to achieve the same purposes may be substituted for the embodiments shown and described without departing from the scope. Those with skill in the art will readily appreciate that embodiments may be implemented in a very wide variety of ways. This application is intended to cover any adaptations or variations of the embodiments discussed herein. Therefore, it is manifestly intended that embodiments be limited only by the claims and the equivalents thereof.

What is claimed is:

1. A kinetic log splitter comprising:

a frame;

a geared rack;

a pinion coupled with the geared rack and to cause the geared rack to translate linearly based on rotation of the pinion; a motor coupled to the pinion;

an actuation handle that engages the geared rack and the pinion, wherein the actuation handle comprises a first upper portion pivotally coupled to a second lower portion, and a spring that couples the first upper portion to the second lower portion, and wherein the spring is configured to release tension during kickback when the force overcomes the spring tension;

a linkage system coupling the actuation handle to the geared rack that allows disengagement of at least a portion of the linkage system in response to a stall condition that occurs due to a stall of the geared rack during the operation of the geared rack of the kinetic log splitter.

2. The kinetic log splitter of claim 1, wherein the linkage comprises a mid-link and an over center linkage, wherein the mid-link couples the actuation handle to the over center linkage.

3. The kinetic log splitter of claim 2, wherein the over center linkage comprises an engagement bearing.

4. The kinetic log splitter of claim 2, wherein the over center linkage comprises a lobe that comes into contact with a fixed point of the frame of the kinetic log splitter, thereby limiting a movement of at least a portion of the over center linkage.

5. The kinetic log splitter of claim 1, wherein the geared rack is free floating and rotation of the actuation handle engages the geared rack with teeth of the pinion.

6. The kinetic log splitter of claim 1, further comprising a kinetic energy absorption component that reduces or absorbs kickback force from disengagement of the linkage system in response to a stall condition.

7. The kinetic log splitter of claim 1, wherein the kinetic energy absorption component comprises a spring.

8. The kinetic log splitter of claim 7, wherein the spring comprises one or more of a tension spring, a compression spring, or a torsion spring.

9. The kinetic log splitter of claim 1, wherein the spring that couples the first upper portion of the handle and a second lower portion of the handle comprises a torsion spring.

10. The kinetic log splitter of claim 1, wherein the mid-link comprises a release slot.

11. The kinetic log splitter of claim 1, wherein the kinetic log splitter is towable.

12. The kinetic log splitter of claim 1, wherein the kinetic log splitter further comprises a push plate splinter recovery system.

13. The kinetic log splitter of claim 11, further comprising:

an extendable towing tongue, wherein the extendable towing tongue extends from the frame and is positionable between a towing configuration and a working configuration;

a collapsible stand, wherein the collapsible stand rotationally fixed to the frame and is positionable between a towing configuration and a working configuration;

a towing locator that locates extendable towing tongue and collapsible stand in the towing configuration; and a pin that is configured to insert into the towing locator to lock the extendable towing tongue in the towing configuration.

14. The towable kinetic log splitter of claim 13, further comprising:

a working locator that positions the collapsible stand in the working position.

15. The towable kinetic log splitter of claim 14, wherein the pin is also configured to insert into the working locator to lock the extendable towing tongue in the working configuration.

16. The towable kinetic log splitter of claim 13, wherein the towing locator is affixed to the extendable towing tongue, and wherein the collapsible stand rotates into position when the extendable towing tongue is in the extended position.

17. The towable kinetic log splitter of claim 13, wherein the extendable towing tongue further comprises a stop that prevents the extendable towing tongue from being pulled from towable kinetic log splitter during towing.

18. The kinetic log splitter of claim 1, where the push plate splinter recovery system, comprises:

a ram that travels down a beam of a kinetic log splitter, the ram further comprising a push plate and one or more guide flanges that guide the push plate down the beam; and one or more rotatable asymmetric pins having a width smaller than a height and wherein rotation of one or more rotatable asymmetric pins releases pressure on the beam allowing for splinter removal.

19. The kinetic log splitter of claim 18, wherein the one or more rotatable asymmetric pins are configured for rotation by a wrench or an inserted shaft.

20. The kinetic log splitter of claim 18, wherein the one or more rotatable asymmetric pins are rotationally coupled to the one or more guide flanges.

* * * * *